US009946215B2

(12) United States Patent
Koizumi et al.

(10) Patent No.: US 9,946,215 B2
(45) Date of Patent: Apr. 17, 2018

(54) IMAGE FORMING APPARATUS THAT SWITCHES BETWEEN A FIRST SUPPLY MODE AND A SECOND SUPPLY MODE

(71) Applicant: CANON KABUSHIKI KAISHA, Tokyo (JP)

(72) Inventors: Kazuhisa Koizumi, Abiko (JP); Teruhiko Suzuki, Tokyo (JP); Eijiro Atarashi, Tokyo (JP); Toshinori Kimura, Tsukuba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/251,310

(22) Filed: Aug. 30, 2016

(65) Prior Publication Data

US 2017/0068204 A1 Mar. 9, 2017

(30) Foreign Application Priority Data

Sep. 8, 2015 (JP) ..... 2015-176530
Sep. 8, 2015 (JP) ..... 2015-176977
Mar. 17, 2016 (JP) ..... 2016-054256

(51) Int. Cl.
*G03G 15/00* (2006.01)
*G03G 21/20* (2006.01)

(52) U.S. Cl.
CPC ..... *G03G 15/80* (2013.01); *G03G 15/5004* (2013.01); *G03G 21/20* (2013.01); *G03G 21/206* (2013.01)

(58) Field of Classification Search
CPC ..... G03G 15/80; G03G 15/5004
USPC ..... 399/88, 82
See application file for complete search history.

(56) References Cited

U.S. PATENT DOCUMENTS

2006/0024079 A1* 2/2006 Sato ..... G03G 15/2039 399/88
2012/0155911 A1* 6/2012 Hirota ..... G03G 15/5004 399/88

FOREIGN PATENT DOCUMENTS

JP 2009-216827 A 9/2009

* cited by examiner

*Primary Examiner* — Billy Lactaoen
(74) *Attorney, Agent, or Firm* — Fitzpatrick, Cella, Harper & Scinto

(57) ABSTRACT

An image forming apparatus having a power saving mode includes a first power supply configured to operate in the power saving mode, a second power supply configured to operate in a mode other than the power saving mode, a heater configured to generate heat when power is fed from the first power supply or the second power supply, and a control circuit configured to control power feeding from the first power supply to the heater and activation or stopping of the second power supply. The control circuit is configured to control, based on an instruction to shift from the power saving mode to another mode, so that power feeding from the first power supply to the heater is cut off, and the second power supply is activated to start power feeding from the second power supply to the heater.

11 Claims, 23 Drawing Sheets

STATUS FOR EACH STATE
(ENVIRONMENT SWITCH 122 IS IN ON STATE)

| | sig. A221 | sig. B222 | sig. C223 | sig. D224 | FIRST POWER SUPPLY 201 | SECOND POWER SUPPLY 205 | CONTROL CIRCUIT B 203 | ENVIRONMENT HEATER 111 |
|---|---|---|---|---|---|---|---|---|
| MAIN SWITCH 230 OFF | L | L | L | L | ON | OFF | OFF | ON (1st POWER SUPPLY) |
| POWER SAVING MODE | L | L | L | L | ON | OFF | OFF | ON (1st POWER SUPPLY) |
| STANDBY 2 MODE | H | L | L | H | ON | ON | OFF | ON (2nd POWER SUPPLY) |
| STANDBY 1 MODE IMAGE FORMING MODE | H | H | H | H | ON | ON | ON | ON (2nd POWER SUPPLY) |

FIG. 12A

STATUS FOR EACH STATE
(ENVIRONMENT SWITCH 122 IS IN OFF STATE)

| | sig. A221 | sig. B222 | sig. C223 | sig. D224 | FIRST POWER SUPPLY 201 | SECOND POWER SUPPLY 205 | CONTROL CIRCUIT B 203 | ENVIRONMENT HEATER 111 |
|---|---|---|---|---|---|---|---|---|
| MAIN SWITCH 230 OFF | L | L | L | L | ON | OFF | OFF | OFF |
| POWER SAVING MODE | L | L | L | L | ON | OFF | OFF | OFF |
| STANDBY 2 MODE | H | L | L | L | ON | OFF | OFF | OFF |
| STANDBY 1 MODE IMAGE FORMING MODE | H | H | H | H | ON | ON | ON | OFF |

FIG. 12B

IMAGE FORMING APPARATUS THAT SWITCHES BETWEEN A FIRST SUPPLY MODE AND A SECOND SUPPLY MODE

BACKGROUND OF THE INVENTION

Field of the Invention

The present invention relates to a technology for controlling a heater included in an image forming apparatus.

Description of the Related Art

In an image forming apparatus having an electrophotographic process, image defects may occur due to, for example, dew condensation caused by environmental fluctuation, such as coldness at night or in the morning depending on the region or season, and a rapid increase in room temperature caused by the use of an air conditioner immediately after the start of work in an office. As a result, in order to prevent dew condensation, there is known a method in which, after the image forming apparatus has been installed, dew condensation is prevented by adding a heater (hereinafter referred to as "environment heater") configured to maintain temperature at a constant level in the image forming apparatus based on the usage environment. The environment heater is installed in the image forming apparatus based on a determination by a maintenance worker or based on the needs of a user.

In recent years, image forming apparatus have been required to have more stable image quality and longer life. In order to satisfy those requirements, it is necessary to further stabilize, in an electrophotographic process, the temperature of parts around a photosensitive drum and the temperature in a cassette in which recording sheets are stored. However, the environment heater is a type of heater to which a fed AC commercial power supply is directly input. In view of this, in Japanese Patent Application Laid-open No. 2009-216827, there is proposed a configuration in which an input circuit to an AC heater is changed depending on a voltage of the AC commercial power supply, which is different in each intended market region.

In Japanese Patent Application Laid-open No. 2009-216827, there is disclosed an environment heater to be selectively mounted to an apparatus main body depending on the voltage of the AC commercial power supply to be used.

However, in the heater configured to use the AC commercial power supply, the amount of heat generated by the heater is increased as the supplied voltage is increased. Therefore, when the AC voltage supplied to the image forming apparatus varies, the amount of heat generated by the AC heater in accordance therewith also varies.

When the voltage of the commercial power supply varies depending on the region in which the image forming apparatus is installed, the amount of heat generated by the AC heater also varies, and hence it is difficult to maintain the temperature at a constant level using the AC heater. In view of this, there has been proposed usage of a DC heater configured to use DC power obtained by subjecting the AC commercial power supply to alternating current/direct current (AC/DC) conversion. The DC heater is used as the environment heater.

In particular, in an image forming apparatus having a power saving mode, power is also required to be fed to a control unit configured to control the state of the power saving mode. In order to feed power to such a control unit, there is provided a control circuit DC power supply configured to constantly output the power supply voltage.

Therefore, there have been proposed usage of the DC heater as the environment heater as described above, and also the usage of the above-mentioned control circuit DC power supply as a power supply of the environment heater.

However, with the configuration described in Japanese Patent Application Laid-open No. 2009-216827, even though measures are taken for each standard value of the voltage of the AC commercial power supply, there are no measures for dealing with variation in the voltage value. In order to tackle this issue, as the environment heater, a configuration using the DC heater may be used. When a DC power supply having an output voltage that is controlled at a constant voltage is used as the power supply for the DC heater, temperature ripples may be reduced even when there is variation in the voltage of the commercial power supply.

However, as the power supply for the DC heater, when a plurality of environment heaters are connected in parallel to a control circuit power supply configured to operate even during the power saving mode, a timing occurs in which power is simultaneously fed to the plurality of environment heaters, which causes the maximum power consumption of the control circuit power supply to increase. As a result, it is necessary to employ a high-output control circuit power supply. However, in this case, there remains a problem in that the power consumption of the image forming apparatus during the power saving mode is increased.

Further, when the DC heater is simply connected in parallel to the control circuit DC power supply as the environment heater, apart from in the power saving mode in which the environment heater is not driven, the power consumption of the control unit is increased in a standby mode or an image forming mode.

Therefore, as the DC power supply, it is necessary to employ a high-output control circuit DC power supply, which is capable of dealing with an increase in the power consumption of the DC heater, which is added to the power consumption of the control unit. However, in this case, there arises a problem in that power of the image forming apparatus during the power saving mode is increased.

In general, a control circuit DC power supply is a power supply configured to feed power to a logic circuit, typified by a central processing unit (CPU) and an application-specific integrated circuit (ASIC), and a load drive DC power supply is a power supply configured to feed power to loads such as motors and a solenoid. Therefore, the load drive DC power supply has a higher voltage than the control circuit DC power supply. When the voltage applied to the DC heater increases when switching from the control circuit DC power supply to the load drive DC power supply, power increases, which may cause abnormal heating. Further, a deviation (hereinafter referred to as "temperature ripple") from a target temperature may increase.

It is a primary object of the present invention to provide an image forming apparatus capable of suppressing an increase in power during the power saving mode.

Further, it is also an object of the present invention to perform, in the image forming apparatus, temperature control by arranging a heater, and to suppress abnormal heating and temperature ripples of the heater.

SUMMARY OF THE INVENTION

According to the present disclosure, an image forming apparatus, which has a first power mode and a second power mode, the second power mode having a lower power consumption than the first power mode, the image forming apparatus comprises: a first power supply unit configured to operate in the first power mode and the second power mode; a second power supply unit configured not to operate in the first power mode but to operate in the second power mode; an image forming unit configured to form an image; a heater configured to heat the image forming unit; and a controller configured to switch a power supply source to the heater from the first power supply unit to the second power supply unit based on a shift from the second power mode to the first power mode, and to switch the power supply source to the heater from the second power supply unit to the first power supply unit based on a shift from the first power mode to the second power mode.

Further features of the present invention will become apparent from the following description of exemplary embodiments (with reference to the attached drawings).

BRIEF DESCRIPTION OF THE DRAWINGS

FIG. 12A is a table for showing a status for each state (environment switch 122 is in an on state), and FIG. 12B is a table for showing a status for each state (environment switch 122 is in an off state).

DESCRIPTION OF THE EMBODIMENTS

Now, an image forming apparatus according to embodiments of the present invention is described with reference to the drawings. The image forming apparatus according to the embodiments is described as an image forming apparatus having an image forming mode and a standby mode as power modes, and a power saving mode.

The image forming mode is the power mode when performing image formation. The standby mode includes a standby 1 mode and a standby 2 mode. The standby 1 mode is the power mode for a state when an image forming operation is capable of starting. The image forming apparatus according to the embodiments is capable of connecting to an external terminal via a network.

When a usage frequency by the user is low, a supply of power to electric loads that are not necessary during the standby 1 mode may be stopped, and a network response via an external terminal may be issued. The standby 2 mode is the power mode that requires a longer time to reach a state in which image formation can be started than that for the standby 1 mode. When the image forming apparatus is not going to be used for a long time, the power saving mode is used. In the power saving mode, the supply of power for network responses is stopped, and standby power is reduced. The level of power consumption of each mode in descending order is the image forming mode, the standby 1 mode, the standby 2 mode, and the power saving mode.

First Embodiment

Figure 1:
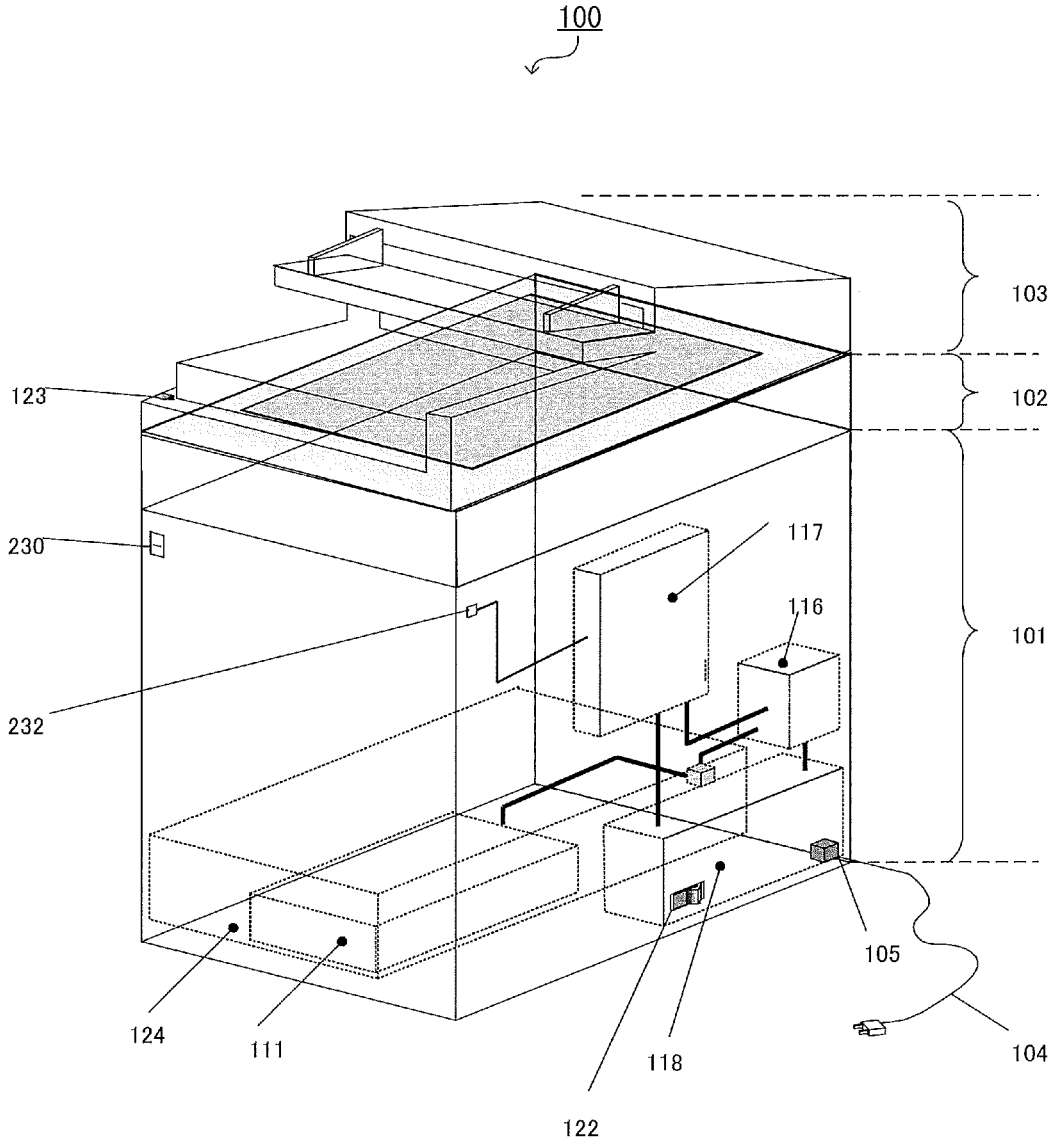
FIG. 1 is a schematic configuration diagram of an image forming apparatus according to an embodiment of the present invention.

FIG. 1 is a schematic configuration diagram of an image forming apparatus 100 according to a first embodiment of the present invention. In FIG. 1, a perspective view of the image forming apparatus 100 as seen from a diagonal rear side thereof is illustrated. The image forming apparatus 100 includes an image forming apparatus main body 101, an image reading unit 102, and a document feeding unit 103. The image forming apparatus main body 101 includes an image forming unit (not shown). An AC cord 104 is for drawing a commercial power supply. A plug shape of the AC cord 104 depends on the intended market. The AC commercial power supply is fed to the apparatus via the AC cord 104 and an inlet 105.

The image forming apparatus 100 according to the first embodiment is configured to be capable of shifting from the image forming mode, which is the mode used when performing image formation or when waiting for image formation to start, or from the standby mode, to the power saving mode, which is a mode having a lower power consumption than a normal power mode. The term standby mode refers to the modes other than the power saving mode. In the following, the modes other than the power saving mode are referred to as a first mode, and the power saving mode is referred to as a second mode.

A main body power supply 118 includes a first power supply (e.g., a constant power supply unit serving as a first power supply unit) 201, which is configured to operate in the power saving mode, and a second power supply (e.g., a non-constant power supply unit serving as a second power supply unit) 205, which is configured to operate in the modes other than the power saving mode. The details of those units are described later with reference to FIG. 2.

The first power supply 201 and the second power supply 205 are DC power supply units configured to output a DC power supply when an AC commercial power supply is supplied. The output DC power supplies are supplied to drive loads (not shown), such as a system controller 117, various types of motors, and a solenoid, via a relay board 116 serving as a power supply distributing unit. Therefore, the first power supply 201 and the second power supply 205 serve as a power supply source for the system controller 117, for example.

The system controller 117 includes a CPU, a read-only memory (ROM) into which control programs and the like are written, and a work random-access memory (RAM) for performing processing. In the system controller 117, a non-volatile memory (not shown) for storing data even when the image forming apparatus 100 is turned off, and an input/output (I/O) port (not shown), for example, are connected to various constituent devices via an address bus and a data bus.

The I/O port is connected to drive loads (not shown), such as motors and the solenoid, a sensor (not shown) configured to detect a conveyance position of a recording sheet on which an image is to be formed, a fixing device (not shown), and the like. The CPU is configured to execute an image forming operation by controlling successive inputs and outputs via the I/O port based on the content of the ROM.

A network port 232 is a communication port configured to be used when an instruction to perform an image forming operation or another operation is issued to the image forming apparatus 100 via an external terminal (not shown). Communication between each terminal and the image forming apparatus 100 is performed under the control of the system controller 117 via the network port 232.

A power mode switching switch 123 is a switch for instructing a switch in the power mode, for example, a shift from a mode other than the power saving mode (first mode) to the power saving mode (second mode) (hereinafter referred to as "shift to the power saving mode"). The power mode switching switch 123 is also a switch for instructing a shift from the power saving mode to a mode other than the power saving mode (hereinafter referred to as "return from the power saving mode"). The power modes relating to the operation of the image forming apparatus 100 can be switched by the user pressing the power mode switching switch 123.

A main switch 230 is a switch that is manually operated in order to turn on and off the power supply of the image forming apparatus 100.

An environment heater 111 is arranged near a sheet feeding cassette 124 in which the recording sheets are stored. The environment heater 111, which is configured as a DC heater, is a resistor having a predetermined resistance value Rh, for example. The power of the environment heater 111 and the amount of heat generated by the environment heater 111 are determined based on the supplied direct voltage. Power feeding control to the environment heater 111 is performed so that power is fed only when an environment switch 122 is in an on state. The environment switch 122, which is manually operated by the user, is configured to function as a switch for switching whether or not power can be fed to the environment heater 111.

In the first embodiment, the environment heater 111 is arranged near the sheet feeding cassette 124 in which the recording sheets are stored. However, the environment heater 111 may be arranged at another position. For example, the environment heater 111 may be arranged near the image forming unit including a photosensitive member and other such parts.

Figure 2:
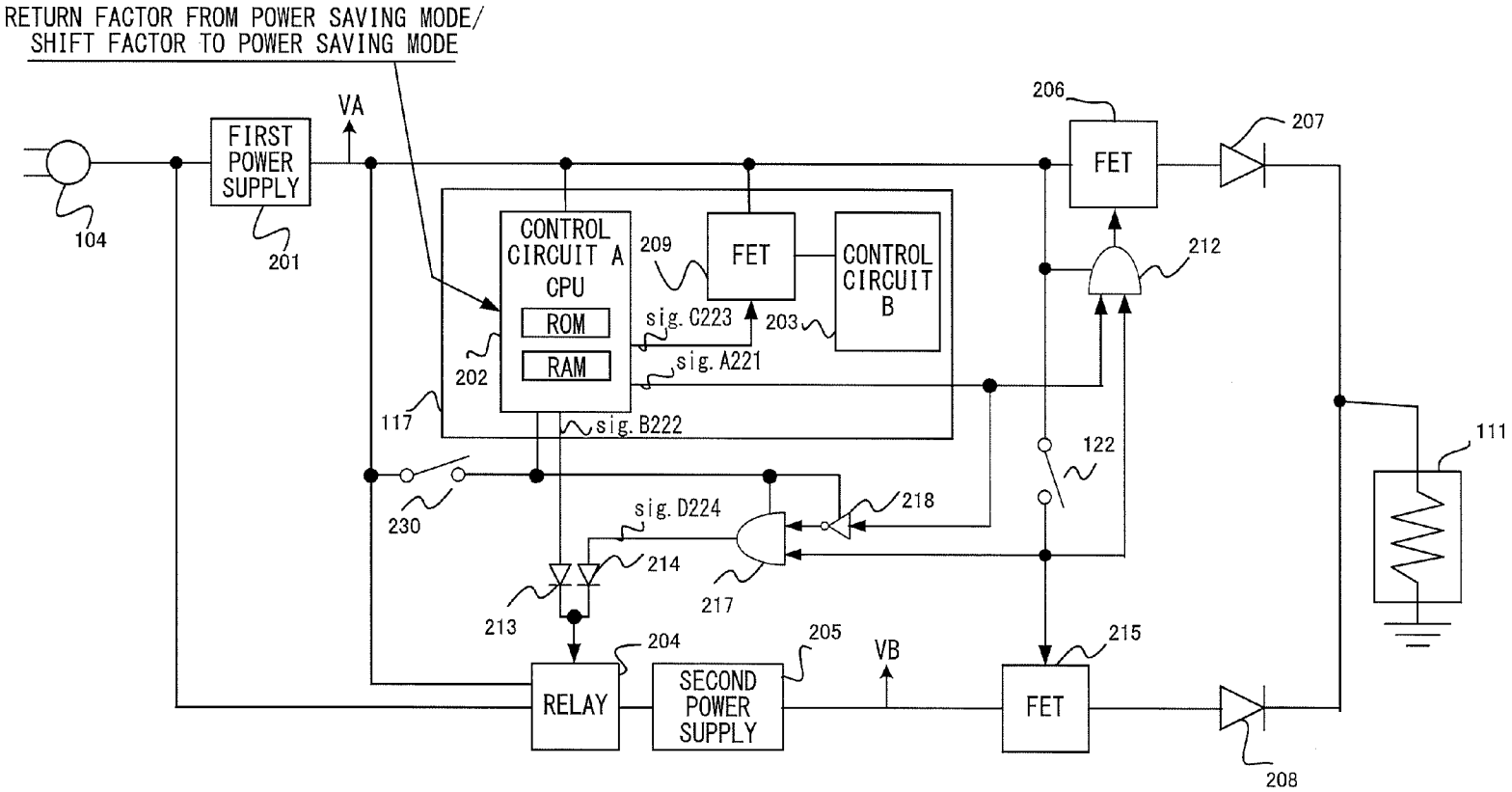
FIG. 2 is a block diagram for illustrating an example of a function configuration of the image forming apparatus.

FIG. 2 is a block diagram for illustrating an example of a function configuration of the image forming apparatus 100.

The first power supply 201 is configured to supply power when the image forming apparatus 100 is connected to a commercial power supply outlet via the AC cord 104. Power is supplied to the system controller 117 via the first power supply 201.

The system controller 117 includes a control circuit A 202 configured to operate even during the power saving mode, and a control circuit B 203 configured to operate in the modes other than the power saving mode but not operate in the power saving mode.

The control circuit A 202 in the system controller 117 is configured to function as a type of computer including a CPU, a ROM in which control programs for controlling various types of processing are stored, and a RAM serving as a system work memory to be used in order to execute the various kinds of processing.

The control circuit A 202 is configured to drive, when a shift factor signal from a mode other than the power saving mode to the power saving mode, or a return factor signal from the power saving mode to a mode other than the power saving mode has been input, a field-effect transistor (FET) 209 based on that shift instruction or return instruction. As a result, the control circuit A 202 is configured to control activation and stopping of the control circuit B 203. The control circuit A 202 is also capable of controlling activation and stopping of the second power supply 205 by driving a relay 204. Further, the control circuit A 202 is capable of controlling power feeding to the environment heater 111, and cutting off of such power feeding, by driving an FET 206.

Examples of the shift factor from a mode other than the power saving mode to the power saving mode may include, in addition to the above-mentioned pressing of the power mode switching switch 123, image formation not being performed for a fixed length of time. Examples of the return factor from the power saving mode to a mode other than the power saving mode may include, in addition to the above-mentioned pressing of the power mode switching switch 123, a request for a connection confirmation response from an externally-connected device and an image formation request.

Power is fed to the environment heater 111 along a first power feeding path and a second power feeding path. In the first power feeding path, a voltage VA from the first power supply 201 is supplied from the FET 206, which is driven by the control circuit A 202, via a diode 207. In the second power feeding path, a voltage VB from the second power supply 205 is supplied via a diode 208.

The second power supply 205 is connected to the drive loads necessary for an image reading operation and an image forming operation, detection elements, and the control unit (not shown) for controlling those elements.

Figure 3:
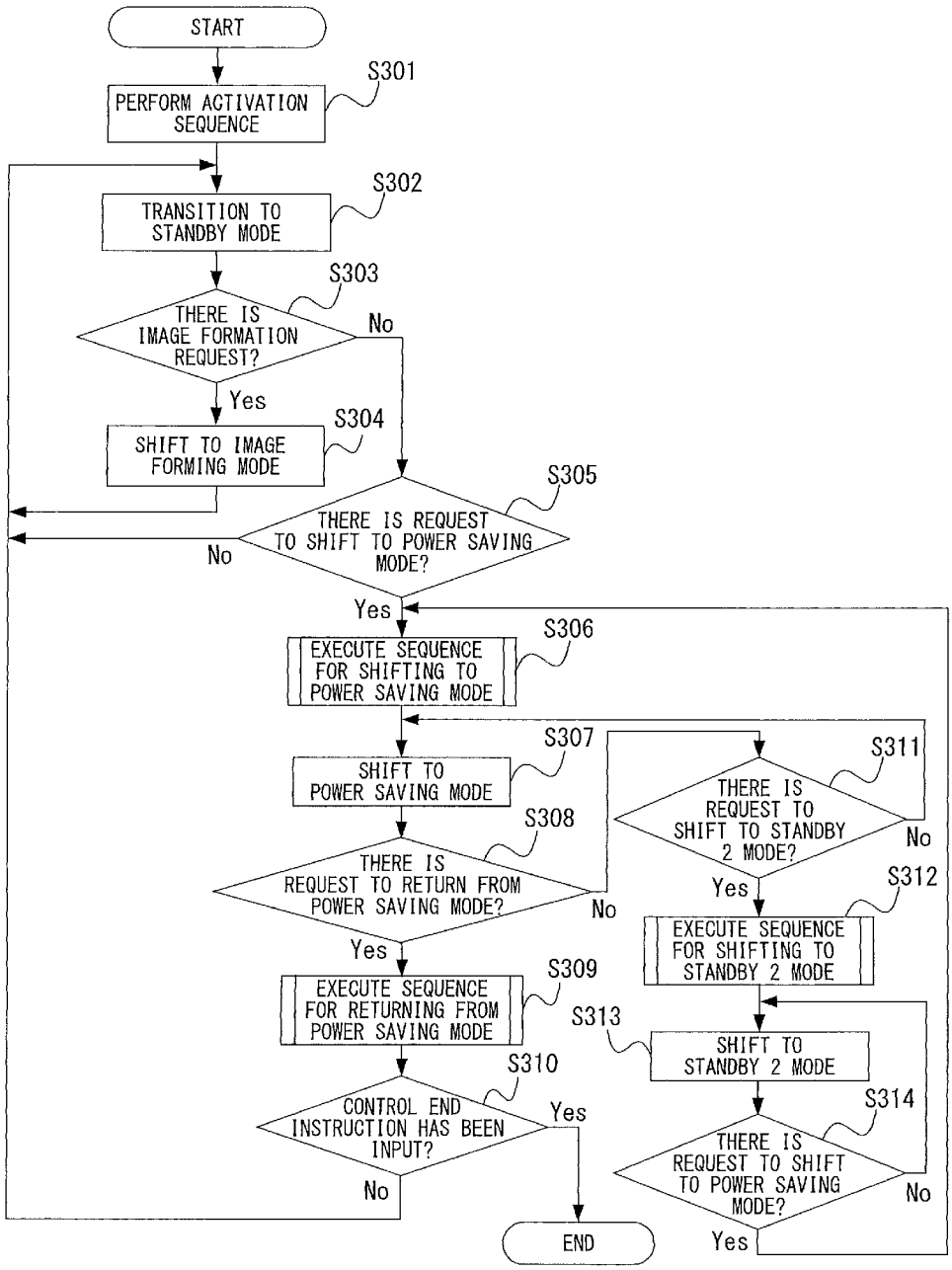
FIG. 3 is a flowchart for illustrating an operation outline of the image forming apparatus.

FIG. 3 is a flowchart for illustrating an operation outline of the image forming apparatus 100. The control processing of the image forming apparatus 100 is mainly performed by the system controller 117.

When power feeding by the AC commercial power supply starts, the image forming apparatus 100 performs activation sequences for executing various types of processing, such as activation of the first power supply 201 and the second power supply 205, confirmation of the state of the image forming apparatus 100, and various types of adjustments (Step S301). Then, the image forming apparatus 100 transitions the state to the standby mode (Step S302).

When the image forming apparatus 100 has received an image formation request from an external terminal (not shown) or the like (Step S303: Yes), the image forming apparatus 100 shifts to the image forming mode and performs an image forming operation (Step S304). After the image forming operation has ended, the image forming apparatus 100 again shifts to the standby mode.

When there has not been an image formation request (Step S303: No), the image forming apparatus 100 determines whether or not there is a request to shift to the power saving mode (Step S305).

When a shift factor signal to the power saving mode has been input by, for example, pressing the power mode switching switch 123 (Step S305: Yes), the image forming apparatus 100 executes a sequence for shifting to the power saving mode (Step S306). In the sequence for shifting to the power saving mode, the image forming apparatus 100 executes processing for stopping the drive loads (not shown), such as the motors and the solenoid, the control circuit B 203, and the second power supply 205. Then, the image forming apparatus 100 shifts to the power saving mode (Step S307).

The image forming apparatus 100 determines whether or not there is a return factor from the power saving mode such as, for example, pressing of the power mode switching switch 123 (Step S308). When a return factor signal from the power saving mode has been input by, for example, pressing the power mode switching switch 123 (Step S308: Yes), the image forming apparatus 100 executes a sequence for returning from the power saving mode (Step S309). In the sequence for returning from the power saving mode, the image forming apparatus 100 executes processing for activating the drive loads (not shown), such as the motors and the solenoid, the control circuit B 203, and the second power supply 205. Then, the image forming apparatus 100 determines whether or not a control end instruction has been input (Step S310). When the control end instruction has been input (Step S310: Yes), the image forming apparatus 100 ends the processing. When the control end instruction has not been input (Step S310: No), the image forming apparatus 100 shifts to the standby mode (Step S302).

When it is determined that there is no return factor from the power saving mode (Step S308: No), the image forming apparatus 100 determines whether or not there is a shift factor to the standby 2 mode such as, for example, a network response request from an external terminal connected to the network (Step S311). When a shift factor signal to the standby 2 mode has been input (Step S311: Yes), the image forming apparatus 100 executes a sequence for shifting to the standby 2 mode (Step S312). The details of the sequence for shifting to the standby 2 mode are described later. The image forming apparatus 100 then shifts to the standby 2 mode (Step S313).

When it is determined that there is no shift factor to the standby 2 mode (Step S311: No), the image forming apparatus 100 returns the processing to Step S306. In this case, the image forming apparatus 100 shifts to the power saving mode.

The image forming apparatus 100 determines whether or not there is a shift factor to the power saving mode, such as a predetermined time having elapsed since the shift to the standby 2 mode (Step S314). When it is determined that there is a shift factor to the power saving mode, such as the predetermined time having elapsed (Step S314: Yes), the image forming apparatus 100 executes the sequence for shifting to the power saving mode (Step S306). When it is determined that there is no such shift factor (Step S314: No), the image forming apparatus 100 returns the processing to Step S313. In this case, the image forming apparatus 100 maintains the standby 2 mode.

The details of the processing performed in Step S309 illustrated in FIG. 3 (sequence for returning from the power saving mode) are now described with reference to FIG. 2 and to the control flowchart illustrated in FIG. 4.

Figure 4:
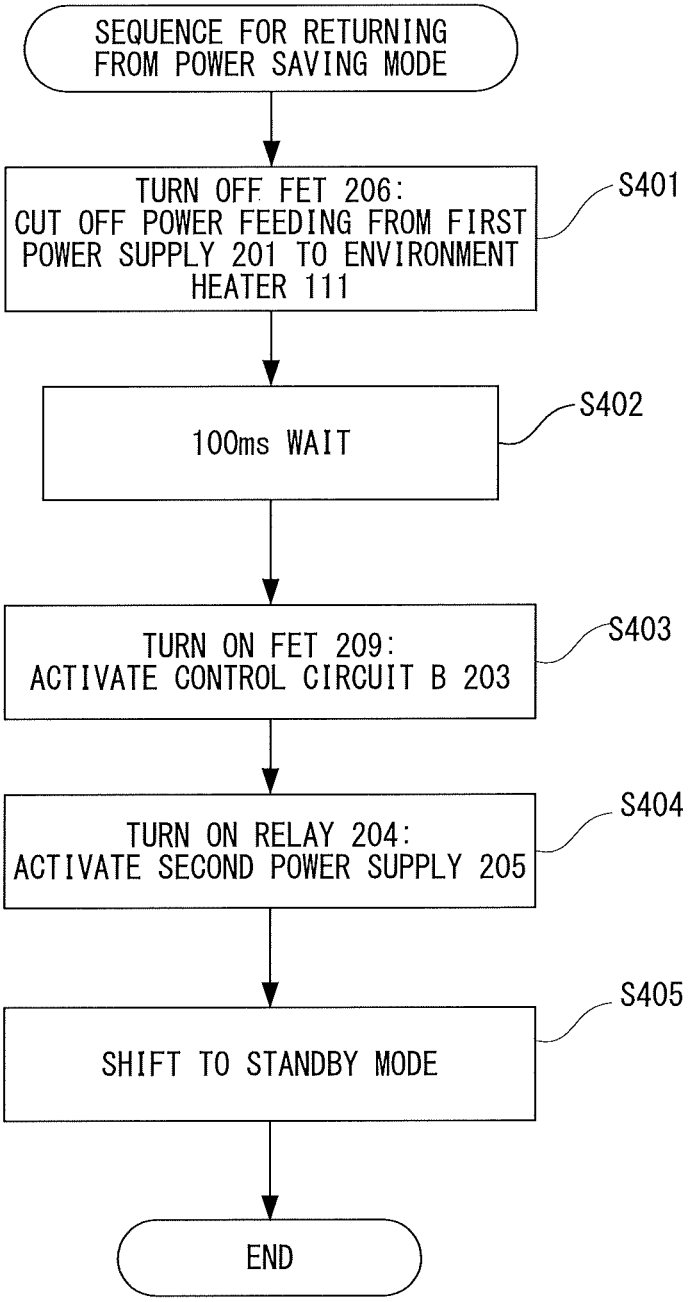
FIG. 4 is a flowchart for illustrating an example of a control procedure when the image forming apparatus returns from a power saving mode.

FIG. 4 is a flowchart for illustrating an example of a control procedure when the image forming apparatus 100 returns from the power saving mode. Each of the following control processing steps is mainly performed by the control circuit A 202.

When a return factor from the power saving mode has been input to the image forming apparatus 100, the control circuit A 202 turns off (OFF) the FET 206 to cut off power feeding from the first power supply 201 to the environment heater 111 (Step S401). More specifically, when a return factor from the power saving mode has been input, the control circuit A 202 outputs a signal sig. A 221, which sets a voltage level to low (L), to an AND circuit 212. When one of two inputs to the AND circuit 212 is an L signal, output from the AND circuit 212 is uniquely determined to be an L signal. As a result, output from the AND circuit 212 to which the signal sig. A 221 has been input becomes an L signal, and the FET 206 is turned off.

After power feeding is cut off, the control circuit A 202 waits until a predetermined time (e.g., 100 [ms]) has elapsed (Step S402). After the predetermined time has elapsed, the control circuit A 202 turns on (ON) the FET 209 to activate the control circuit B 203 (Step S403). More specifically, the control circuit A 202 outputs a signal sig. C 223, which sets the voltage level to high (H), to the AND circuit 212 to turn on the FET 209.

The control circuit A 202 then turns on (ON) the relay 204 to activate the second power supply 205 (Step S404). More specifically, the control circuit A 202 outputs a signal sig. B 222 to turn on the relay 204 via a diode 213. When the activation of the second power supply 205 is complete and the activation of the loads necessary for the image forming operation has been confirmed, the control circuit A 202 shifts the image forming apparatus 100 to the standby mode (Step S405).

Thus, when the image forming apparatus 100 returns from the power saving mode to the standby mode, the control circuit B 203 may be activated without increasing the power consumption of the first power supply 201, and power feeding to the environment heater 111 may be switched from the first power supply 201 to the second power supply 205.

The operations performed on the first power supply 201 side and the operations performed on the second power supply 205 side relating to the state of the environment switch 122 are now described.

On the first power supply 201 side, when the environment switch 122 is in an on state, an H signal is input to the AND circuit 212, which is arranged upstream of the FET 206. Further, output from the AND circuit 212 is determined based on the voltage level of the signal sig. A 221. When the environment switch 122 is in an off state, an output from the AND circuit 212 is an L signal regardless of the voltage level of the signal sig. A 221, and hence the FET 206 is stopped.

On the second power supply 205 side, when the environment switch 122 is in an on state, an H signal is input to an AND circuit 217, and a signal sig. D 224, which is an output signal from the AND circuit 217, is similarly determined based on the voltage level of the signal sig. A 221.

Because a NOT circuit 218 is arranged on the upstream side of the AND circuit 217, output from the AND circuit 217 has an exclusive relation with output from the AND circuit 212 described above. Output from the AND circuit 217 is input to the relay 204 via a diode 214, and a determination is made to activate the second power supply 205. When the environment switch 122 is in an off state, the signal sig. D 224 is an L signal. As long as the image forming apparatus 100 is not in the standby mode, namely, as long as the signal sig. B 222 is not an H signal, the relay 204 is turned off, and hence the second power supply 205 is not activated.

The switching of the environment switch 122 determines whether or not an FET 215, which is arranged downstream from the second power supply 205, is turned on or off. During the standby mode, during which the signal sig. B 222 is an H signal, the relay 204 is turned on to activate the second power supply 205. In the standby mode, when the environment switch 122 is in an off state, power feeding to the environment heater 111 is cut off by the FET 215. In the following description, unless noted otherwise, the environment switch 122 is in an on state.

The details of the processing performed in Step S312 illustrated in FIG. 3 (sequence for shifting from power saving mode to standby 2 mode) are now described with reference to FIG. 2 and to the control flowchart illustrated in FIG. 13.

Figure 13:
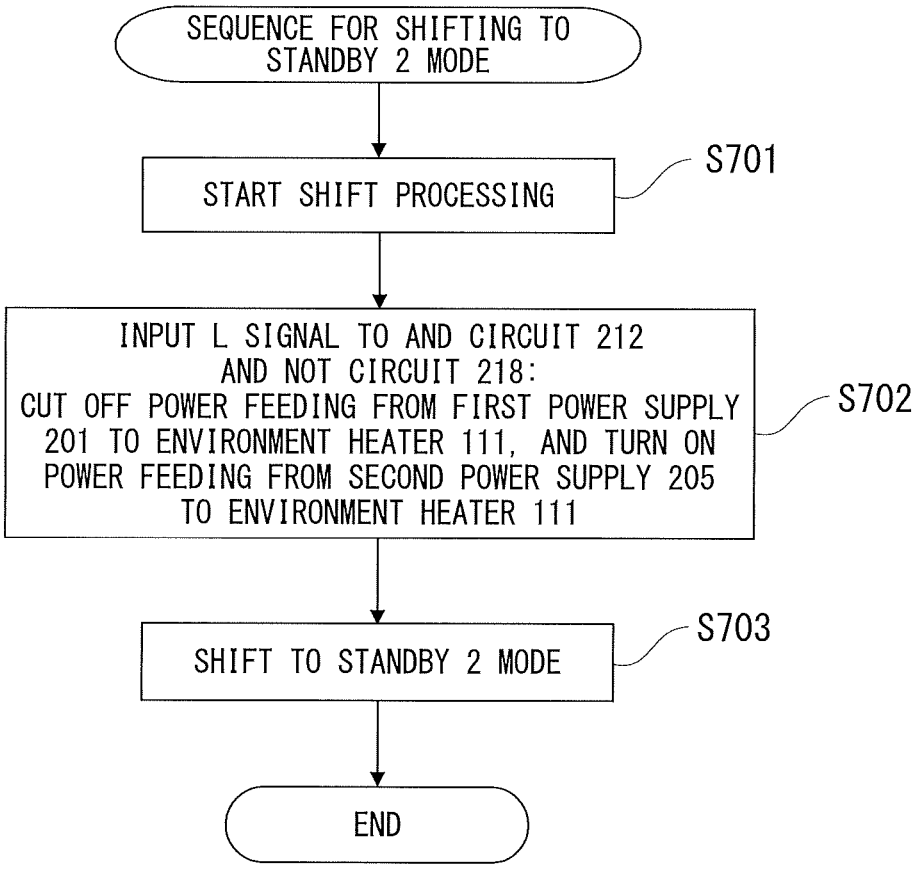
FIG. 13 is a flowchart for illustrating an example of a control procedure when the image forming apparatus shifts from the power saving mode to a standby 2 mode.

FIG. 13 is a flowchart for illustrating an example of a control procedure when the image forming apparatus 100 shifts from the power saving mode to the standby 2 mode. Each of the following control processing steps is mainly performed by the control circuit A 202.

The control circuit A 202 starts the sequence for shifting to the standby 2 mode (shift processing) when a network response request has been input to the image forming apparatus 100 from an external terminal connected to the network (Step S701).

The control circuit A 202 cuts off power feeding from the first power supply 201 to the environment heater 111 by setting the signal sig. A 221 to an L signal, which causes an output from the AND circuit 212 to be an L signal, thereby stopping the FET 206. The control circuit A 202 also inputs the signal sig. A 221 to the NOT circuit 218 and the AND circuit 217. As a result, the signal sig. D 224, which is the output signal from the AND circuit 217, becomes an H signal, the relay 204 is turned on, and the second power supply 205 is activated (Step S702). Then, the control circuit A 202 shifts to the standby 2 mode (Step S703).

Thus, in the standby 2 mode, power feeding to the environment heater 111 switches from the first power supply 201 to the second power supply 205. During the standby 2 mode, the system controller 117 is driven in order to handle the network response. As a result, when power continues to be fed from the first power supply 201 as is, the necessary power level can no longer be met. Therefore, during the standby 2 mode, the power supply source of the environment heater 111 is switched to the second power supply 205. In this case, when the environment switch 122 is in an off state, an L signal is input to the AND circuit 217, the signal sig. D 224 becomes an L signal, the relay 204 is turned off, and the second power supply 205 is stopped.

The relations among the various above-mentioned output signals (signal sig. A 221 and the like) from the control circuit A 202 in each mode of the image forming apparatus 100 and the states of the first power supply 201, the second power supply 205, the control circuit B 203, and the environment heater 111 are now described with reference to FIG. 12A and FIG. 12B.

FIG. 12A and FIG. 12B are tables for showing the status of each constituent device in each mode. In FIG. 12A and FIG. 12B, the state of the main switch 230 and each mode are shown on the vertical axis, and the states of each output signal, the first power supply 201, the second power supply 205, the control circuit B 203, and the environment heater 111 are shown on the horizontal axis. In FIG. 12A, a case is shown in which the environment switch 122 is in an on state and the environment heater 111 is activated. In FIG. 12B, a case is shown in which the environment switch 122 is in an off state and the environment heater 111 is stopped.

In each mode, the state of the environment heater 111 is switched based on whether the environment switch 122 is in an on state or an off state. When the environment switch 122 is in an on state, the environment heater 111 is in a heat-generating state.

The case when the environment switch 122 is in anon state is now described. When the main switch 230 is turned off under a state in which the AC commercial power supply is being supplied by the AC cord 104, and when the image forming apparatus 100 is in the power saving mode, the first power supply 201 is operating, and power is fed to the environment heater 111 by the first power supply 201. When the image forming apparatus 100 is in the standby 2 mode, and when the image forming apparatus 100 is in the standby mode or the image forming mode, namely, when the image forming apparatus 100 is in a mode other than the power saving mode, power is fed to the environment heater 111 by the second power supply 205.

When the image forming apparatus 100 is in the standby mode or the image forming mode, the second power supply 205 feeds power to the environment heater 111 as well as to each load in the image forming apparatus 100. In contrast, when the image forming apparatus 100 is in the standby 2 mode, because only the network response is operating, the image forming apparatus 100 is controlled so that power is fed only to the environment heater 111. As a result, when the environment heater 111 is not to be used, it is necessary to turnoff the environment switch 122 in order to prevent the second power supply 205 from being unnecessarily activated.

In the image forming apparatus 100 according to the first embodiment, during the standby 2 mode, the signal sig. D 224 may be switched between an H signal and an L signal based on whether the environment switch 122 is in an on state or an off state, and the relay 204 and the second power supply 205 may also be switched between being on or off.

Activation of the relay 204 is executed when the signal sig. D 224 is an H signal. Therefore, it is necessary for the signal sig. A 221 to be an H signal and the environment switch 122 to be in an on state. During the standby mode and the image forming mode, the signals sig. A 221, sig. B 222, sig. C 223, and sig. D 224 are each an H signal, the first power supply 201, the second power supply 205, and the control circuit B 203 are activated, and power is fed to the environment heater 111 from the second power supply 205.

The case when the environment switch 122 is in an off state is now described. In such a case, the environment heater 111 is in a stopped state in each mode. The states of the signal sig. A 221 to signal sig. D 224, the first power supply 201, the second power supply 205, and the control circuit B 203 are, other than in the standby 2 mode, the same as when the environment switch 122 is an on state. As described above, in the case of the standby 2 mode, the signal sig. D 224 is set to L to stop the relay 204 in order to prevent the second power supply 205 from being unnecessarily activated.

Figure 5:
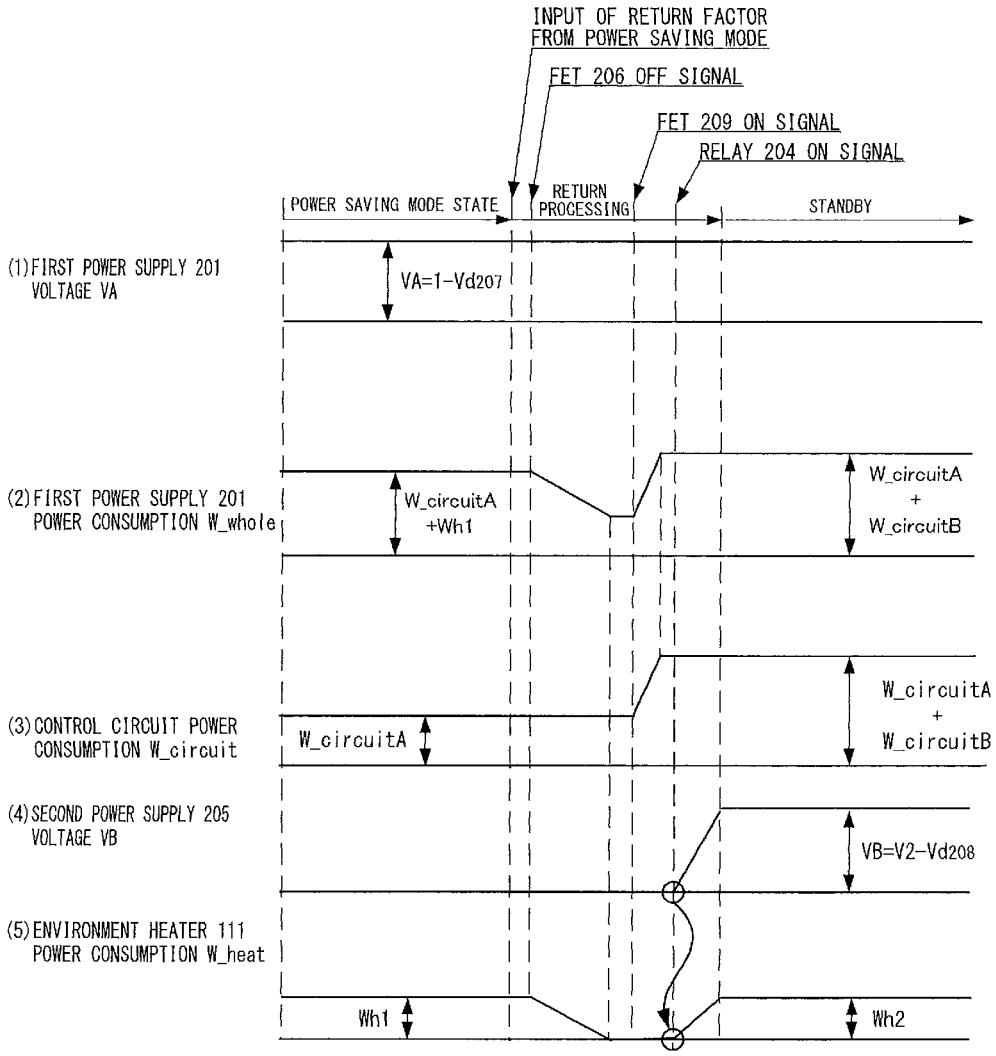
FIG. 5 is a timing chart for illustrating details of the control procedure described with reference to FIG. 4.

FIG. 5 is a timing chart for illustrating the details of the control procedure described with reference to FIG. 4.

A first row (1) on the vertical axis of the timing chart illustrated in FIG. 5 is the voltage VA [V] (rated output voltage value V1−Vd 207) of the first power supply 201, and a second row (2) is a power consumption W_whole [W] of the first power supply 201. A third row (3) on the vertical axis is a total power consumption W_circuit [W] of the control circuit A 202 and the control circuit B 203, and a fourth row (4) is the voltage VB [V] (rated output voltage value V2−Vd 208) of the second power supply 205. A fifth row (5) on the vertical axis is a power consumption W_heat [W] of the environment heater 111.

When the image forming apparatus 100 is in the power saving mode, each of the rows (1) to (5) in the timing chart illustrated in FIG. 5 is in the following state.

The voltage ((1)) of the first power supply 201 is VA=V1−Vd 207 [V], the power consumption ((2)) of the first power supply 201 is W_whole=W_circuit A+Wh1 [W], and the power consumption ((3)) of the control circuits is W_circuit=W_circuit A[W]. The voltage ((4)) of the second power supply 205 is VB=0 [V], and the power consumption ((5)) of the environment heater 111 is W_heat=VA2/Rh.

In this case, the voltage V1 is the rated output voltage value of the first power supply 201, the W_circuit A is the power consumption value of the control circuit A 202, the W_circuit B is the power consumption value of the control circuit B 203, and the Rh is the resistance value of the environment heater 111. The power consumption Wh1 is the power consumption value of the environment heater 111 when the voltage VA of the first power supply 201 is in a supplied state, and the power consumption Wh2 is the power consumption value of the environment heater 111 when the voltage VB of the second power supply 205 is in a supplied state. In the first embodiment, to simplify the description, a voltage drop of the FETs 206, 209, and 215, the diodes 213 and 214, the NOT circuit 218, and the AND circuits 212 and 217 is 0 [V].

When the voltage drop of the diode 207 is Vd 207 and the voltage drop of the diode 208 is Vd 208, Vd 207<Vd 208. Further, V1−Vd 207=V2−Vd 208.

The control circuit A 202 of the image forming apparatus 100 turns off the FET 206 by setting the signal sig. A 221 to an L signal based on an input of a return factor from the power saving mode indicated on the horizontal axis of FIG. 5 (refer to the processing in Step S401). As a result, the power consumption ((2)) W_whole of the first power supply 201 starts to drop as illustrated in FIG. 5 due to a decrease in the power consumption Wh1 of the environment heater 111.

At a timing after waiting for a predetermined time (refer to the processing in Step S402), there is no longer any effect of the power consumption Wh1 from the power consumption ((2)) W_whole of the first power supply 201. Then, the control circuit A 202 sets the signal sig. B 222 to an H signal to turn on the FET 209 (refer to the processing in Step S403). As a result, the control circuit B 203 is activated, and the power consumption ((2)) W_whole of the first power supply 201 starts to increase, as illustrated in FIG. 5.

As a result, the power consumption W_circuit B of the control circuit B 203 is added, and the power consumption ((2)) W_whole of the first power supply 201 becomes the total of the power consumption W_circuit A of the control circuit A 202 and the power consumption W_circuit B of the control circuit B 203.

Thus, the image forming apparatus 100 is controlled so that cutting off of power feeding from the first power supply 201 to the environment heater 111 is started, and after cut off is complete, the control circuit B 203 is activated. As a result, the power consumption W_whole of the first power supply 201 does not have a period in which the power consumption W_circuit B of the control circuit B 203 overlaps the power consumption Wh1 of the environment heater 111.

Further, in the image forming apparatus 100, the second power supply 205 is activated by turning on the relay 204 last, and power feeding to the environment heater 111 is started together with the resultant voltage increase (VB from 0). As a result, the environment heater 111 is in a state consuming W_heat=Wh2=VB2/Rh power.

At this stage, based on the fact that V1−Vd 207=V2−Vd 208, Wh1=Wh2. Because there is no change to the heater temperature even when the power supply of the environment heater 111 is switched, it is necessary that Wh1=Wh2. In the description of the first embodiment, Wh1=Wh2 is established due to the voltage drop of the diodes. However, the configuration of this feature is not limited, and may also be achieved by, for example, a voltage-dividing circuit.

For example, when switching of the power feeding path to the environment heater 111 is not controlled in synchronization with input of a return factor and a shift factor from the power saving mode, the low-output type first power supply 201 continues to feed power to the environment heater 111 as is. In other words, the control circuit B 203 performs a normal mode operation while the first power supply 201 continues to feed power to the environment heater 111 as is. In this case, the power needed by the environment heater 111 cannot be fully met by the first power supply 201, causing a voltage drop to occur, thereby giving rise to a problem in that operation of the image forming apparatus 100 becomes unstable.

A case is now described in which switching of the power feeding path to the environment heater 111 is not controlled in consideration of the time taken to drive/stop the FET 206 and the time taken to drive/stop the FET 209, namely, in consideration of drive completion. In this case, there is a timing at which power feeding to the environment heater 111 during a mode shift and the normal mode operation of the control circuit B 203 overlap, which causes the same problem as described above to occur.

When a high-output type first power supply 201 is employed, the above-mentioned problem does not occur, but during the power saving mode, the image forming apparatus 100 operates in a region in which the power efficiency of the first power supply 201 is low during the power saving mode. As a result, power loss by the first power supply 201 increases, causing the power consumption of the image forming apparatus 100 during the power saving mode to increase.

The details of the processing performed in Step S306 illustrated in FIG. 3 (sequence for shifting from standby mode to power saving mode) are now described with reference to the control flowchart illustrated in FIG. 6.

Figure 6:
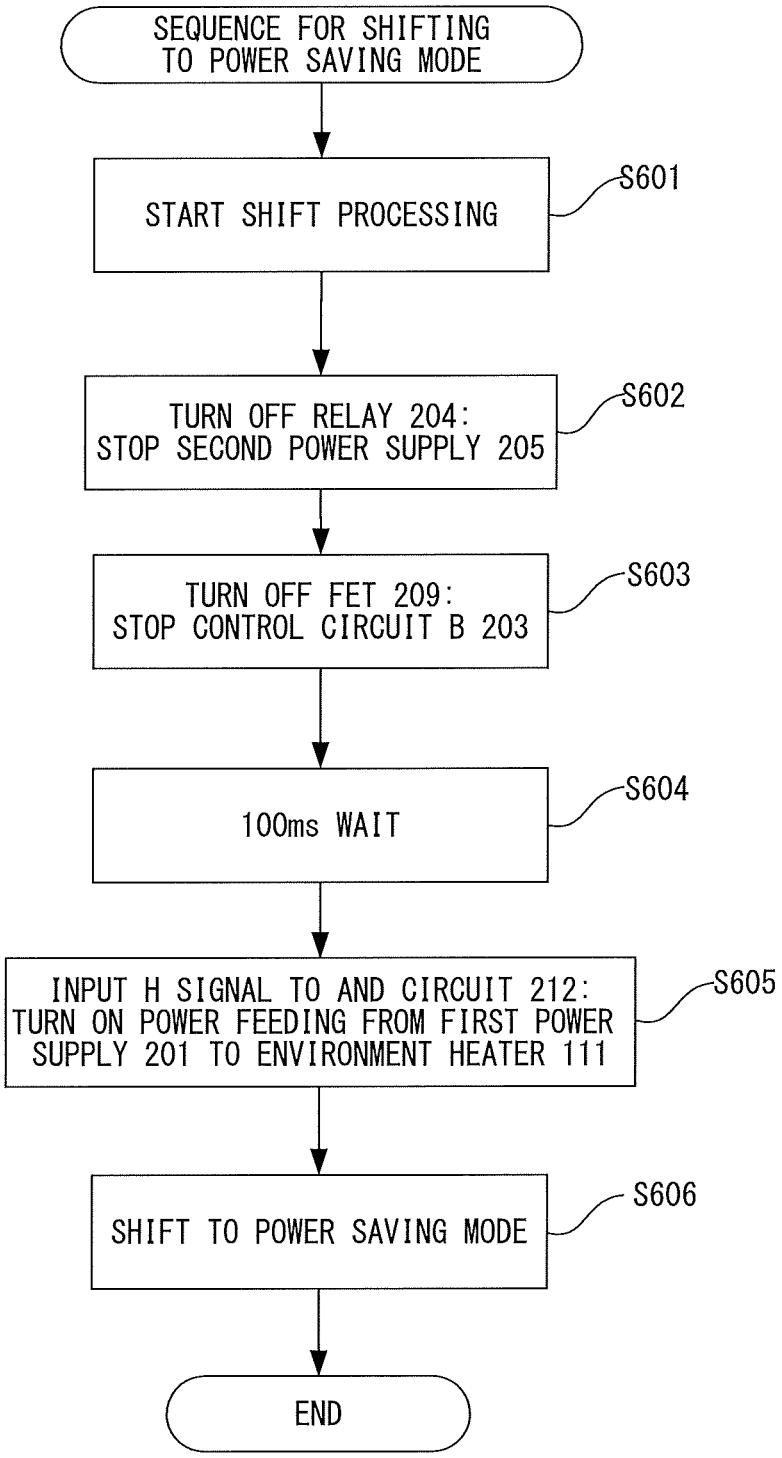
FIG. 6 is a flowchart for illustrating an example of a control procedure when the image forming apparatus shifts to the power saving mode.

FIG. 6 is a flowchart for illustrating an example of the control procedure when the image forming apparatus 100 shifts to the power saving mode. Each of the following control processing steps is mainly performed by the control circuit A 202.

When a shift factor to the power saving mode is input when the image forming apparatus 100 is in the standby mode, the control circuit A 202 starts shift processing (Step S601). Further, processing such as backing-up necessary data is executed.

The control circuit A 202 turns off (OFF) the relay 204 to cut off the AC commercial power supply to the second power supply 205 (Step S602). More specifically, after the shift processing has ended, the control circuit A 202 sets the signal sig. B 222 to an L signal, meaning that an L signal is input to the diode 213. The control circuit A 202 also sets the signal sig. A 221 to an H signal, meaning that an H signal is input to the NOT circuit 218 and the AND circuit 217. As a result, the signal sig. D 224 becomes an L signal, meaning that an L signal is input to the diode 214. Therefore, because inputs to the diodes 213 and 214 are both L signals, the relay 204 is turned off.

The control circuit A 202 turns off (OFF) the FET 209 to stop operation of the control circuit B 203 (Step S603). The control circuit A 202 waits for a predetermined time (e.g., 100 [ms]) (Step S604), and then turns on (ON) the FET 206 to enable (turn on) the power feeding path from the first power supply 201 to the environment heater 111 (Step S605). More specifically, the control circuit A 202 turns on the FET 206 by controlling so that output from the AND circuit 212 is an H signal by setting the signal sig. A 221 to an H signal. Then, the image forming apparatus 100 shifts to the power saving mode (Step S606).

The details of the control procedure described with reference to FIG. 6 are now described with reference to the timing chart illustrated in FIG. 7.

Figure 7:
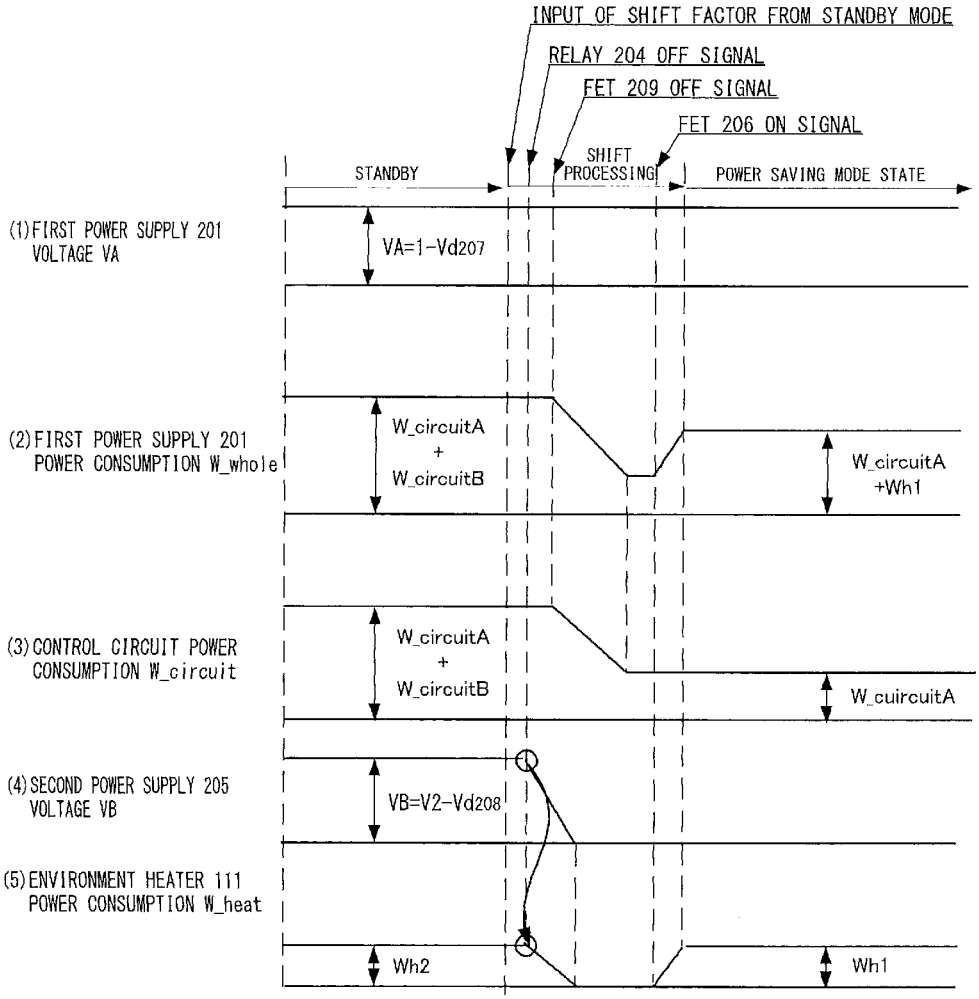
FIG. 7 is a timing chart for illustrating details of the control procedure described with reference to FIG. 6.

FIG. 7 is a timing chart for illustrating the details of the control procedure described with reference to FIG. 6. The vertical axis (each row) of the timing chart illustrated in FIG. 6 is the same as that in FIG. 5, and hence a description thereof is omitted here.

When the image forming apparatus 100 is in the standby mode, each of the rows (1) to (5) in the timing chart illustrated in FIG. 7 are in the following state.

The voltage ((1)) of the first power supply 201 is VA=V1−Vd 207 [V], and the power consumption ((2)) of the first power supply 201 is W_whole=W_circuit A+W_circuit B[W]. The power consumption ((3)) of the control circuits is W_circuit=W_circuit A+W_circuit B [W]. The voltage ((4)) of the second power supply 205 is VB=V2−Vd208 [V], and the power consumption ((5)) of the environment heater 111 is W_heat=VB2/Rh.

The control circuit A 202 of the image forming apparatus 100 executes, based on input of a shift factor to the power saving mode indicated on the horizontal axis of FIG. 7, shift processing under a state in which operation of the control circuit A 202 and operation of the control circuit B 203 are maintained (refer to the processing in Step S601). The power consumption ((3)) of the control circuits at this stage is power consumption W_circuit=W_circuit A+W_circuit B [W].

The control circuit A 202 turns off the relay 204 by setting the signal sig. B 222 to an L signal (refer to the processing in Step S602). Through performing this step, the AC commercial power supply to the second power supply 205 is cut off. As a result, as illustrated in FIG. 7, the voltage ((4)) of the second power supply 205 starts to drop from the voltage V2.

The control circuit A 202 stops operation of the control circuit B 203 by setting the signal sig. C 223 to an L signal to turn off the FET 209 (refer to the processing in Step S603). As a result, the power consumption ((3)) W_circuit of the control circuits starts to decrease by the amount of power consumption of the power consumption W_circuit B of the control circuit B 203. Therefore, the power consumption ((3)) W_circuit of the control circuits after a predetermined time has elapsed (refer to the processing in Step S604) is only the power consumption W_circuit A of the control circuit A 202.

The control circuit A 202 enables the power feeding path from the first power supply 201 to the environment heater 111 by setting the signal sig. A 221 to an H signal to turn on the FET 206 (refer to the processing in Step S605). As a result, power is supplied from the first power supply 201 to the environment heater 111, and the power consumption ((2)) W_whole of the first power supply 201 is in a state in which the power consumption W_heat of the control circuit A 202 and the environment heater 111 is equal to VA2/Rh (refer to the processing in Step S307).

Thus, in the image forming apparatus 100, there is a timing at which power feeding to the environment heater 111 is cut off when returning from the power saving mode and when shifting from the standby mode to the power saving mode.

However, because the cut-off duration is short, the effect on the temperature of the parts near the sheet feeding cassette 124 of the recording sheets (or image forming unit (not shown)) is small.

Figure 8:
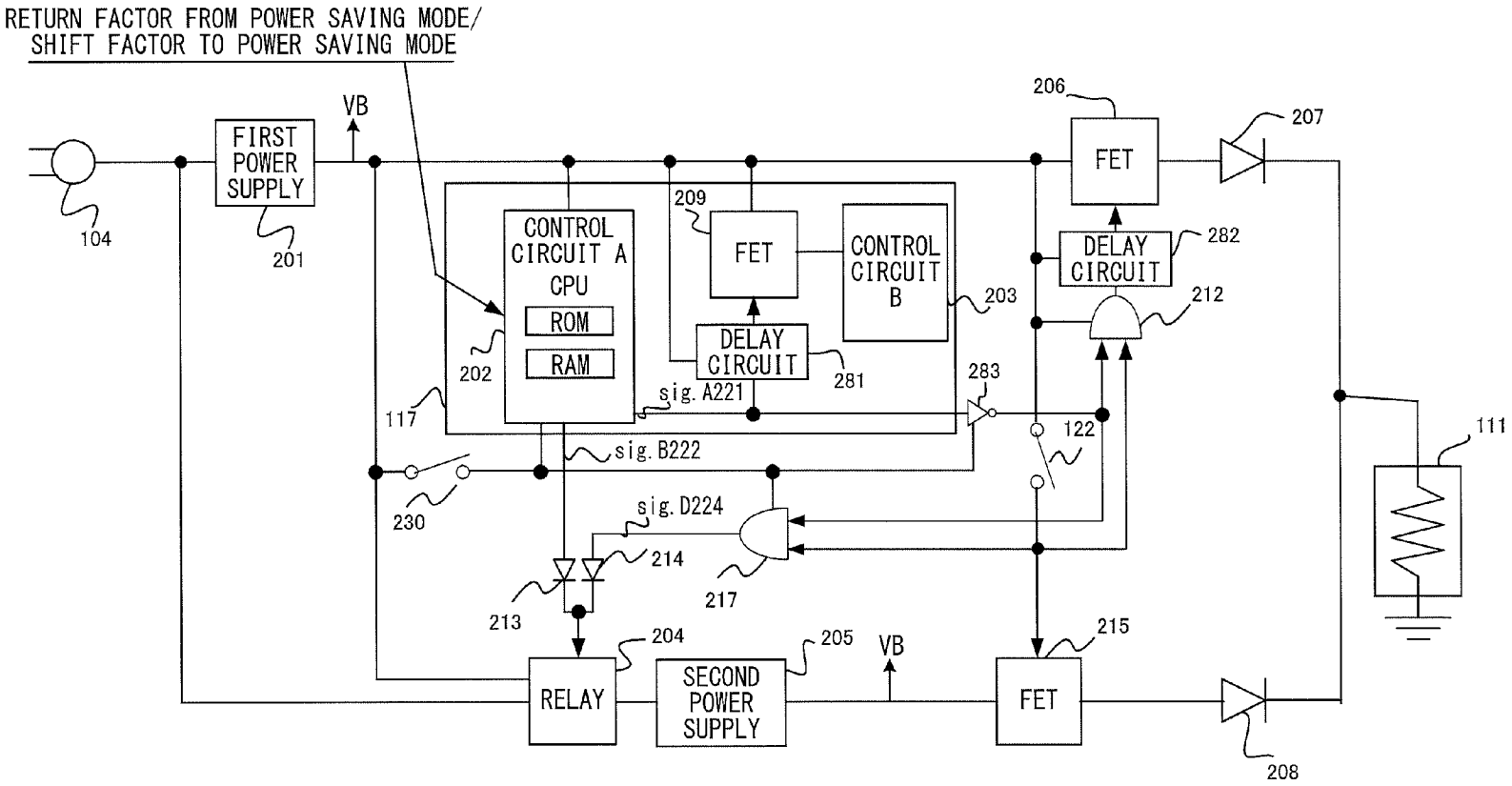
FIG. 8 is a block diagram for illustrating an example of a function configuration of the image forming apparatus different from that illustrated in FIG. 2.

The control operations (exclusive control operations by the FETs) performed by the control circuit A 202 relating to each of the processing steps in Steps S401 to S403 illustrated in FIG. 4 and the processing steps in Steps S603 to S605 illustrated in FIG. 6 may also be implemented by a hardware circuit illustrated in FIG. 8.

FIG. 8 is a block diagram for illustrating an example of a function configuration of the image forming apparatus 100 different from that illustrated in FIG. 2.

In the function configuration of the image forming apparatus 100 illustrated in FIG. 8, the drive signal from the control circuit A 202 is connected to the FET 209 via a delay circuit 281. The drive signal is also connected to the FET 206 via a NOT circuit 283 and a delay circuit 282. The delay circuits 281 and 282 are designed such that a rising delay time increases from after an input signal becomes an H signal until an output signal becomes an H signal. The delay circuits 281 and 282 are also designed such that a falling delay time from after the input signal becomes an L signal until the output signal becomes an L signal is zero, or is sufficiently smaller than the rising delay time.

The point that each of the processing steps may be implemented even by a hardware circuit is now described with reference to FIG. 9A and FIG. 9B.

Figure 9A:
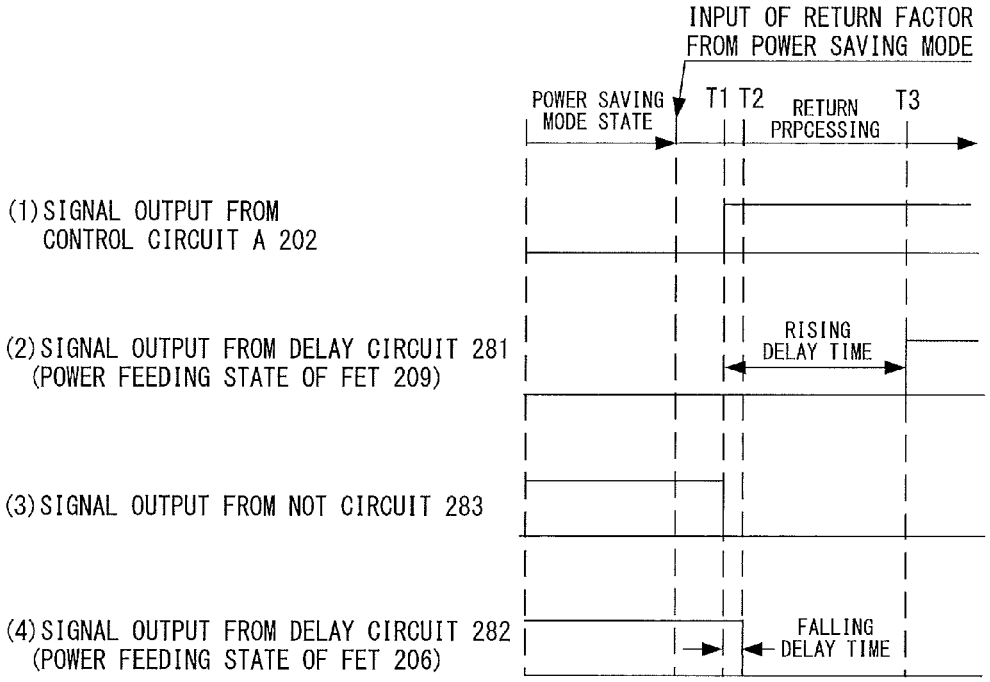
FIG. 9A and FIG. 9B are timing charts for illustrating examples of configurations when a capacitor is connected in parallel to the environment heater.
Figure 9B:
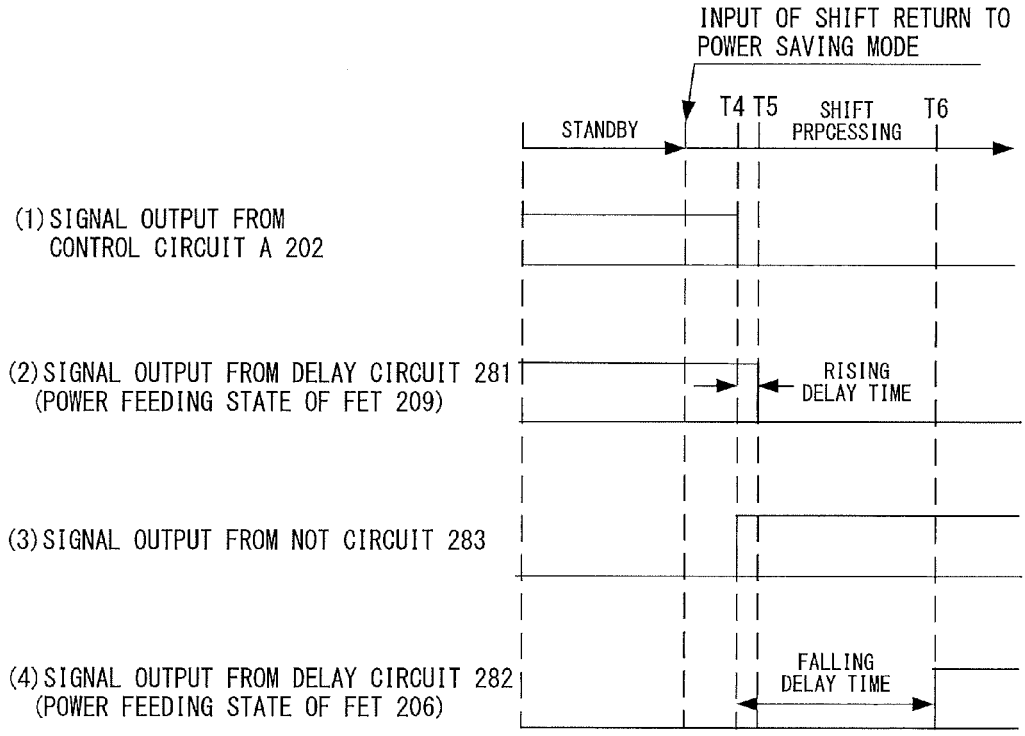

FIG. 9A and FIG. 9B are timing charts for illustrating examples of configurations when a capacitor is connected in parallel to the environment heater 111. First, the point that each of the processing steps of Steps S401 to S403 (sequence for returning from power saving mode) illustrated in FIG. 4 can be implemented by using the hardware circuit illustrated in FIG. 8 is now described with reference to the timing chart of FIG. 9A.

The first row (1) on the vertical axis of the timing chart illustrated in FIG. 9A is a signal output of the control circuit A 202, the second row (2) is the signal output of the delay circuit 281 (i.e., power feeding state of FET 209), the third row (3) is the signal output of the NOT circuit 283, and the fourth row (4) is the signal output of the delay circuit 282 (i.e., power feeding state of FET 206).

At a timing T1 indicated in FIG. 9A, when the control circuit A 202 sets the off control of the FET 206 illustrated in FIG. 4 (refer to the processing in Step S401), namely, sets the signal sig. A 221 to an H signal, an H signal is input to the NOT circuit 283.

The NOT circuit 283 inverts the input signal, and outputs an L signal to the delay circuit 282. After the falling delay time, the delay circuit 282 outputs an L signal to the FET 206 at a timing T2 to turn off the FET 206. In synchronization with this control, an H signal (signal sig. A 221 is set to an H signal) is input to the delay circuit 281 at the timing T1. The delay circuit 281 receives the H signal, and then after the rising delay time has elapsed (corresponding to the processing in Step S402), turns on the FET 209 at a timing T3 (refer to the processing in Step S403).

Next, the point that each of the processing steps of Steps S603 to S605 (sequence for shifting to power saving mode) illustrated in FIG. 6 can be implemented by using the hardware circuit illustrated in FIG. 8 is now described with reference to the timing chart of FIG. 9B. The vertical axis of FIG. 9B has the same configuration as the vertical axis of FIG. 9A, and hence a description thereof is omitted here.

At a timing T4 indicated in FIG. 9B, when the control circuit A 202 sets the off control of the FET 209 illustrated in FIG. 6 (refer to the processing in Step S603), namely, sets the signal sig. A 221 to an L signal, an L signal is input to the delay circuit 281. The delay circuit 281 receives the L signal, and after the falling delay time, outputs the L signal to the FET 209 at a timing T5 to turn off the FET 209. In synchronization with this control, an L signal (signal sig. A 221 is set to an L signal) is input to the NOT circuit 283 at the timing T4. The NOT circuit 283 inverts the input signal, and outputs an H signal to the delay circuit 282.

The delay circuit 282 outputs an H signal to the FET 206 at a timing T6 after the rising delay time (corresponding to the processing in Step S604) to turn on the FET 206 (refer to the processing in Step S605).

The hardware circuit illustrated in FIG. 8 is described as a circuit in which the FET 206 and the FET 209 are driven by H signals. In addition to such a configuration, as a circuit configured to drive the FETs by L logic, the circuit may instead be designed so that the control circuit A 202 and the delay circuit 281 are connected via the NOT circuit 283, and the control circuit A 202 and the delay circuit 282 are directly connected.

Further, as a circuit configured to drive the FETs by L logic, the circuit may instead be designed so that the control logic of the control circuit A 202 when shifting modes is the opposite to that described above, and the relationship between the rising delay time and the falling delay time of the delay circuits is also the opposite to that described above.

In addition, the control circuit A 202 is described in the first embodiment by using a CPU, but the control circuit A 202 may also be configured from a hardware circuit configured to drive the FET 206 and the relay 204 by synchronizing the return factor signal and the shift factor signal from the power saving mode with the input signal.

Figure 10:
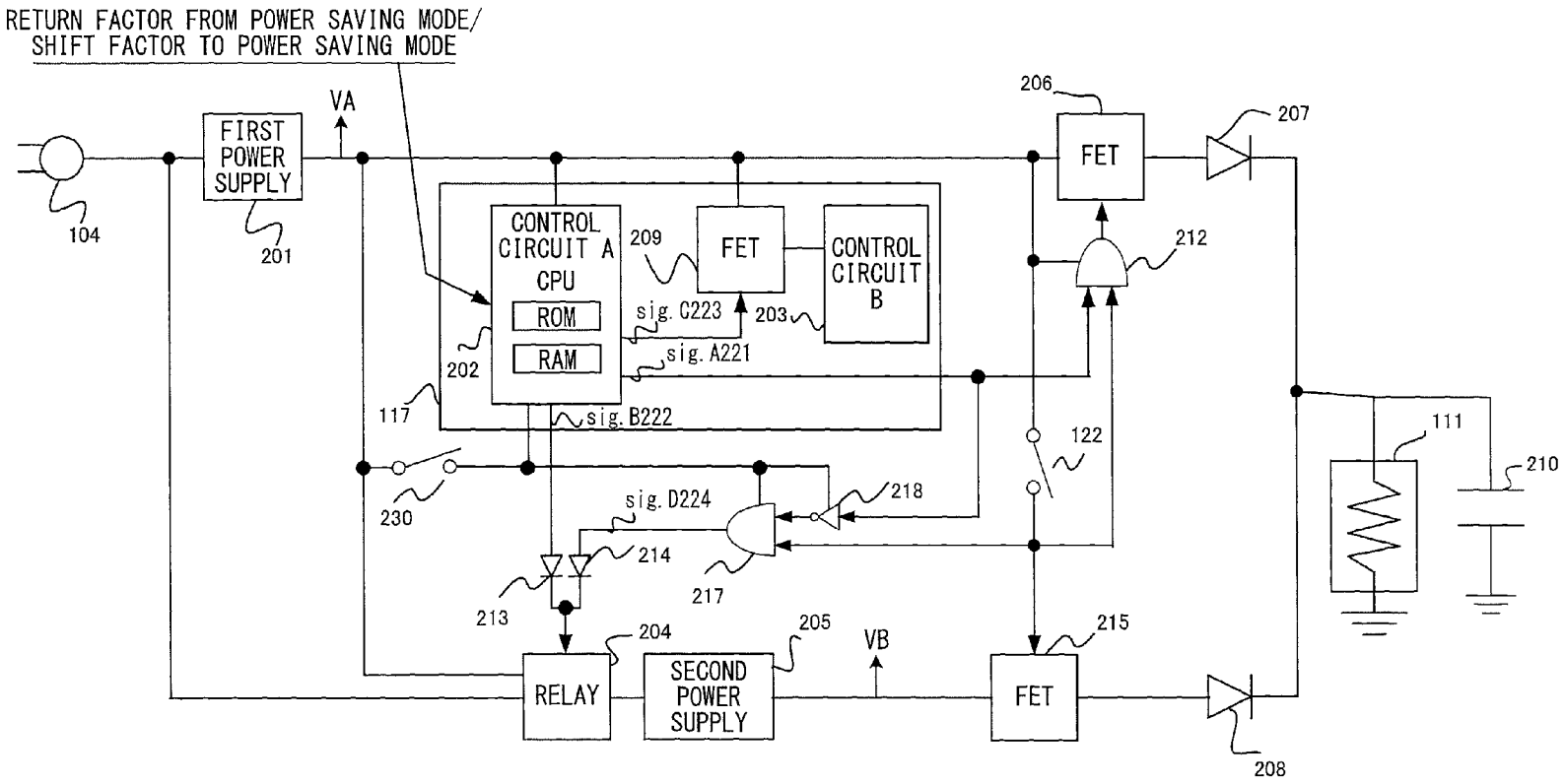
FIG. 10 is a block diagram for illustrating an example of a function configuration of the image forming apparatus different from FIG. 2 and FIG. 8.

FIG. 10 is a block diagram for illustrating an example of a function configuration of the image forming apparatus 100 different from FIG. 2 and FIG. 8.

As illustrated in FIG. 10, when a capacitor 210 having a predetermined capacitance is connected in parallel to the environment heater 111, power can be fed to the environment heater 111 from charge accumulated in a capacitor (capacitive load) 210 even at a timing immediately after switching of the first and second power supplies. As a result, as illustrated in a timing chart, because a decrease in the power consumption can be moderated, a decrease in the amount of heat generation can be suppressed.

Figure 11:
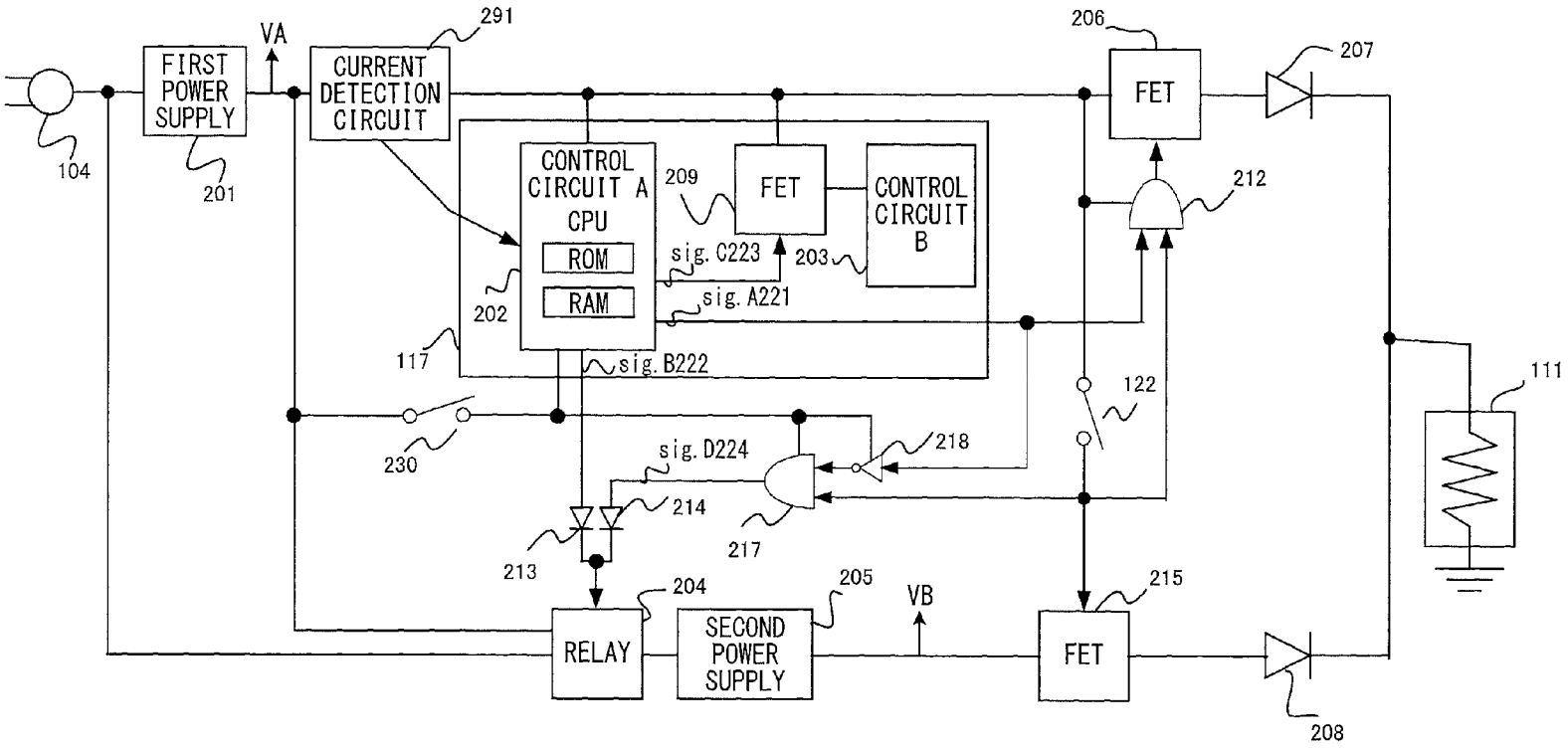
FIG. 11 is a block diagram for illustrating an example of a function configuration of the image forming apparatus different from FIG. 2, FIG. 8, and FIG. 10.

FIG. 11 is a block diagram for illustrating an example of a function configuration of the image forming apparatus 100 different from FIG. 2, FIG. 8, and FIG. 10.

As illustrated in FIG. 11, a current detection circuit 291 configured to detect a consumption current of the first power supply 201 is arranged on the power supply path of the first power supply 201 as a return factor from the power saving mode. A circuit configuration in which the FET 206 and the relay 204 are driven when a detection signal (detection value) of the current detection circuit 291 is a predetermined value or more may also be employed.

Thus, with the image forming apparatus 100 according to the first embodiment, power feeding to the environment heater (DC heater) 111 during the power saving mode is performed from the first power supply (constant power supply) 201, and the power feeding path from the first power supply 201 is cut off when shifting to a mode other than the power saving mode. During modes other than the power saving mode, power feeding to the environment heater 111 is performed from the second power supply (non-constant power supply) 205. As a result, an increase in power during the power saving mode can be suppressed. In other words, even when using a DC heater (direct current heater) as the environment heater 111, a low-output power supply can be used as the first power supply 201, and the power consumption amount during the power saving mode can be suppressed.

Second Embodiment

Figure 14:
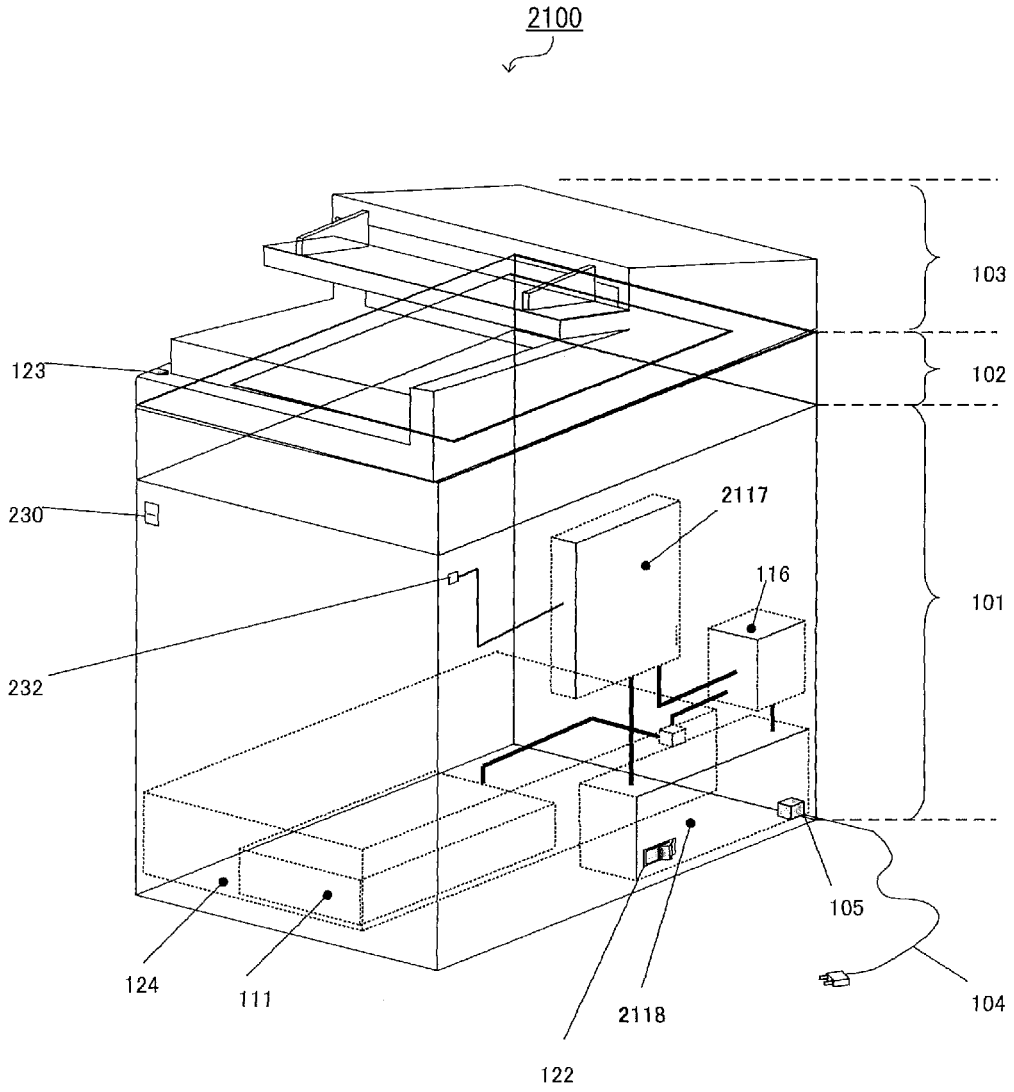
FIG. 14 is a schematic configuration diagram of the image forming apparatus according to this embodiment.

FIG. 14 is a schematic configuration diagram of an image forming apparatus 2100 according to a second embodiment of the present invention. In FIG. 14, a perspective view of the image forming apparatus 2100 as seen from a diagonal rear side thereof is illustrated. In the image forming apparatus 2100, a system controller 2117 includes, similar to the system controller 117 illustrated in FIG. 1, a CPU, a ROM into which control programs and the like are written, and a work RAM for performing processing. In the system controller 2117, a non-volatile memory (not shown) for storing data even when the image forming apparatus 2100 is turned off, and an I/O port (not shown), for example, are connected to various constituent devices via an address bus and a data bus.

A main body power supply 2118 includes a control circuit DC power supply 2201, which is configured to operate in the power saving mode and during the normal power mode, and a load drive DC power supply 2205, which is configured to operate in the modes other than the power saving mode. The DC power supply 2201 and the DC power supply 2205 are configured to operate as direct current power supplies outputting a direct current. In order to simplify the drawings, the DC power supply 2201 and the DC power supply 2205 are only illustrated in FIG. 15, which is described later, and are not illustrated in FIG. 14. The main body power supply 2118 is described in more detail later with reference to FIG. 15. Unless noted otherwise, other parts in the image forming apparatus 2100 illustrated in FIG. 14 are similar to those of the image forming apparatus 100 illustrated in FIG. 1 of the first embodiment.

The system controller 2117 is configured to control the DC power supply 2205 so that the DC power supply 2205 does not operate in the power saving mode, but does operate in other modes. The system controller 2117 is also configured to control the DC power supply 2201 so that the DC power supply 2201 operates in the power saving mode.

Figure 15:
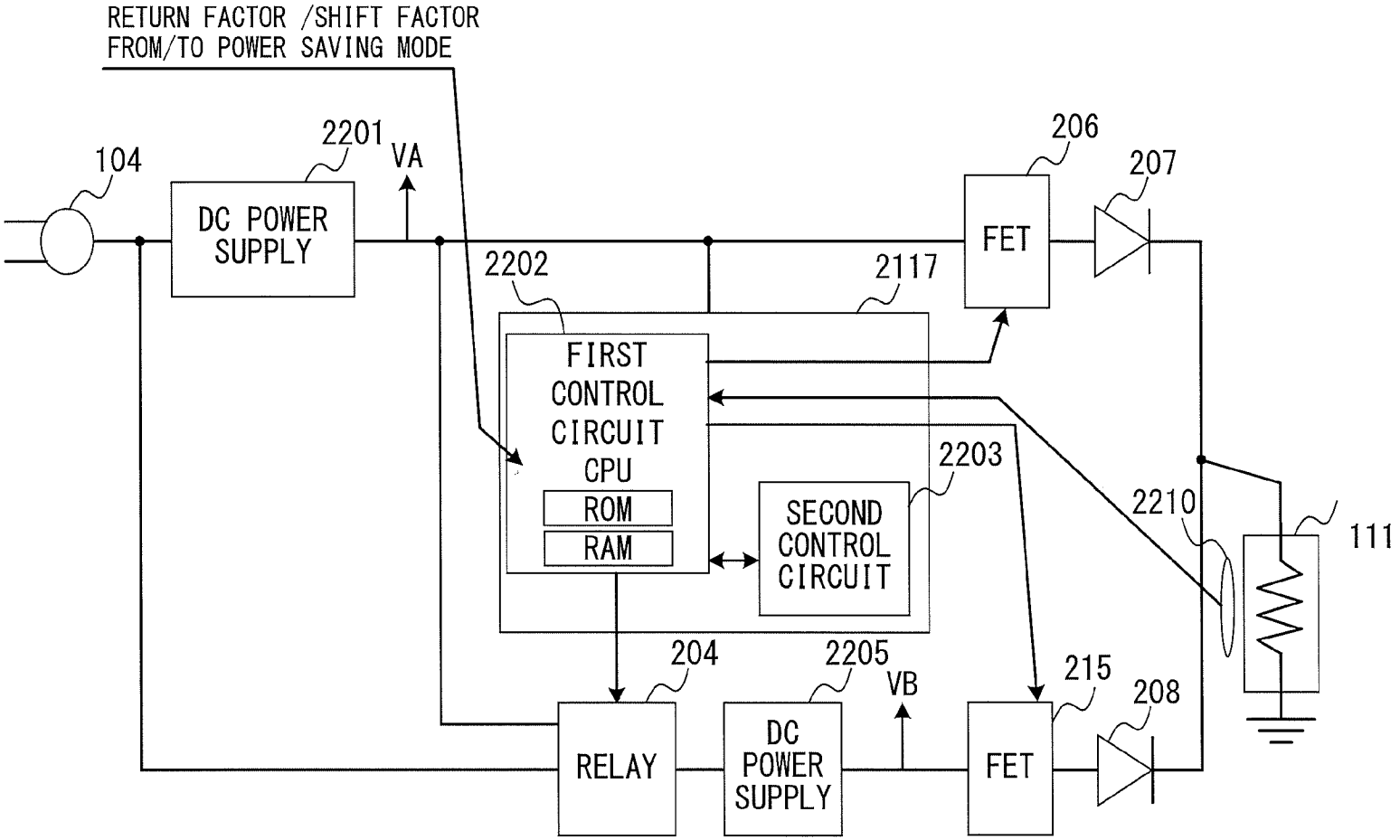
FIG. 15 is a block diagram for illustrating an example of a function configuration of the image forming apparatus.

FIG. 15 is a block diagram for illustrating an example of the function configuration of the image forming apparatus 2100. As illustrated in FIG. 15, when the plug of the AC cord 104 is connected to a commercial outlet, power is supplied to the DC power supply 2201 connected to the system controller 2117. The AC cord 104 is configured to supply power to the DC power supply 2205 via the relay 204. The DC power supply 2201 is connected to the environment switch 122, the FETs 206 and 209, and the relay 204.

As illustrated in FIG. 15, the system controller 2117 includes a first control circuit 2202 configured to operate in the normal power mode and the power saving mode, and a second control circuit 2203 configured not to operate in the power saving mode but to operate in the other modes.

The first control circuit 2202 in the system controller 2117 is configured to function as a type of computer including a CPU, a ROM in which control programs for controlling various types of processing are stored, and a RAM serving as a system work memory to be used in order to execute the various kinds of processing. The second control circuit 2203 is similarly configured, but in order to simplify the drawings, the CPU, the ROM, and the RAM are not illustrated. The environment heater 111 includes a temperature sensor 210 configured to detect temperature, which allows an ambient temperature around the environment heater 111 to be detected. The ambient temperature detected by the temperature sensor 210 is transmitted to the first control circuit 2202. The first control circuit 2202 is configured to refer to the transmitted ambient temperature, and to control the temperature of the environment heater 111 by controlling ON/OFF of the FET 206 or the FET 215.

The DC power supply 2205 is connected to drive loads, such as the motors and the solenoid, necessary for the image reading operation and the image forming operation, detection elements, and the control unit (not shown) configured to control those elements. The second control circuit 2203 is configured to control those drive loads.

Power feeding to the environment heater 111 is performed via a first power feeding path and a second power feeding path. The first power feeding path is a path for the DC power supply 2201 to feed power from the FET 206 to the environment heater 111 via the diode 207. The second power feeding path is a path for the DC power supply 2205 to feed power to the environment heater 111 via the diode 208.

When the request signal for shifting to the power saving mode or the request signal for returning from the power saving mode is input from the mode switching switch 123, the system controller 2117 performs the following operations through the CPU 131 of the first control circuit 2202 depending on the input signal.

(1) Activation of the second control circuit 2203 and stop control
(2) Activation of the DC power supply 2205 by driving the relay 204 and stop control
(3) Power feeding to the environment heater 111 from the DC power supply 2201 by driving the FET 206 and cut-off control
(4) Power feeding to the environment heater 111 from the DC power supply 2205 by driving the FET 215 and cut-off control As the request to return from the power saving mode and the request to shift to the power saving mode, in addition to the above-mentioned pressing of the mode switching switch 123, there is an image formation request from an externally connected device and the like.

In this embodiment, power feeding of Items (3) and (4) is possible only when the environment switch 122 is in an on state. Further, even when the environment switch 122 is absent, the first control circuit can also control the energization state to the environment heater 111, to thereby always set the environment heater to a non-power feeding state.

Next, an outline of the processing executed by the system controller 2117 of the image forming apparatus 2100 is described with reference to the control flowchart illustrated in FIG. 16. Unless noted otherwise, each processing step in the flowchart is executed by the system controller 2117 via the CPU 131.

When power feeding to the image forming apparatus 2100 via the AC cord 104 by the AC commercial power supply starts, power is supplied from the DC power supply 2201 to the system controller 2117.

The CPU 131 of the system controller 2117 performs activation sequences for executing various types of processing, such as activation of the DC power supply 2205, confirming the state of the image forming apparatus 2100, and various types of adjustments (Step S301), and then transitions the state to the normal power mode (Step S302). Then, the CPU 131 determines whether or not there is an image formation request from an externally connected device, the image reading unit 102, or other such devices (Step S303).

When there is an image formation request (Step S303: Yes), the CPU 131 performs an image forming operation (Step S304), and again shifts to the normal power mode of Step S302. When there is no image formation request (Step S303: No), the CPU 131 determines whether or not a request to shift to the power saving mode has been input by, for example, pressing the power mode switching switch 123 (Step S305).

When it is determined that there is no shift request (Step S305: No), the CPU 131 again executes Step S302. When it is determined that there is a shift request (Step S305: Yes), the CPU 131 performs a sequence, which is described later, for shifting to the power saving mode (Step S306), and then transitions the state to the power saving mode (Step S307).

Then, the CPU 131 determines whether or not a request to return from the power saving mode has been input by, for example, pressing the power mode switching switch 123 (Step S308). When a return request has not been input (Step S308: No), the CPU 131 again executes Step S307. When a return request has been input (Step S308: Yes), the CPU 131 executes a sequence, which is described later, for returning from the power saving mode (Step S309). The CPU 131 then determines whether or not a control end instruction has been input (Step S310). When there has been a control end instruction (Step S310: Yes), the CPU 131 ends the processing. When there is no control end instruction (Step S310: No), the CPU 131 again executes Step S302.

Figure 16:
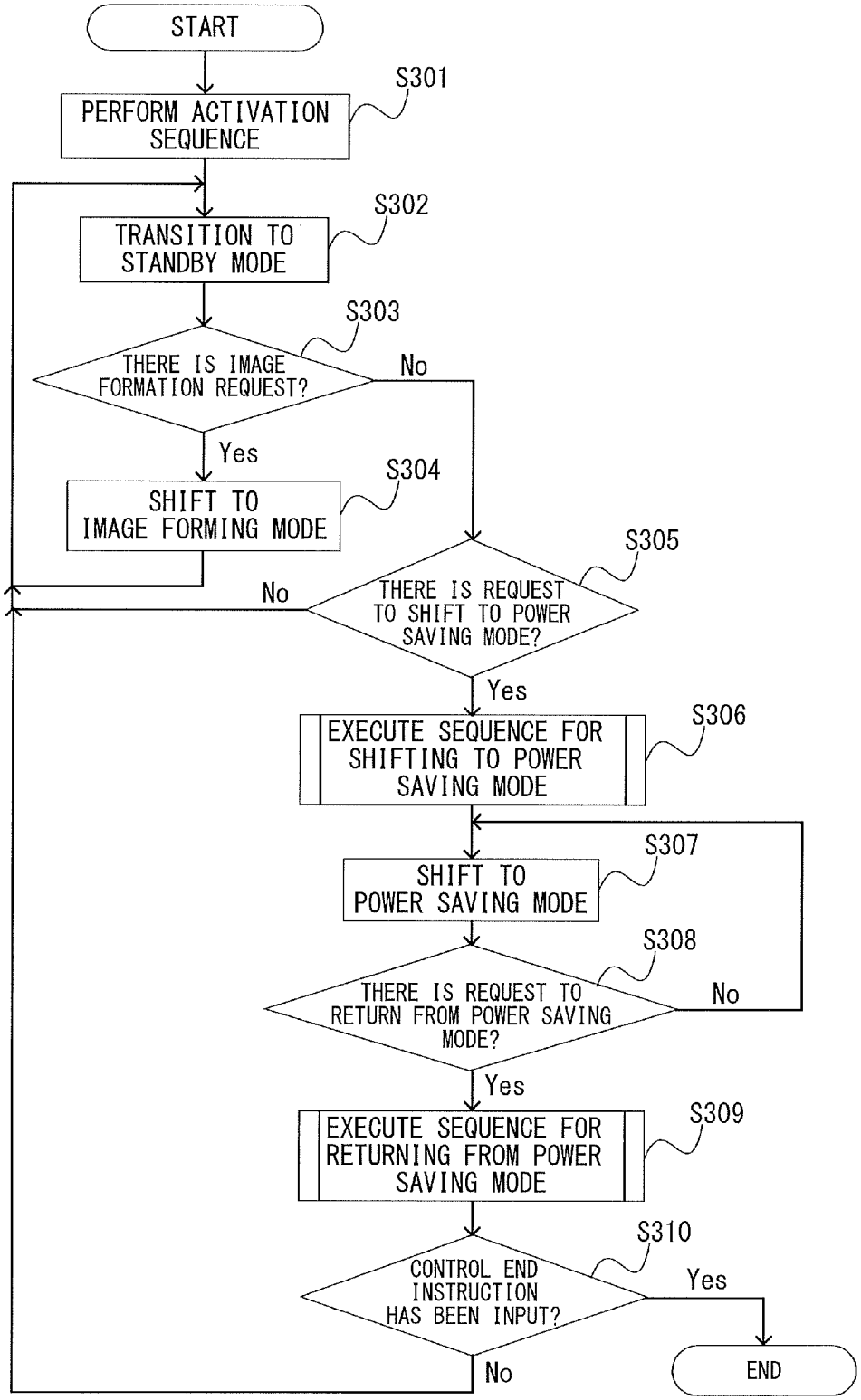
FIG. 16 is a flowchart for illustrating an operation outline of the image forming apparatus.
Figure 17:
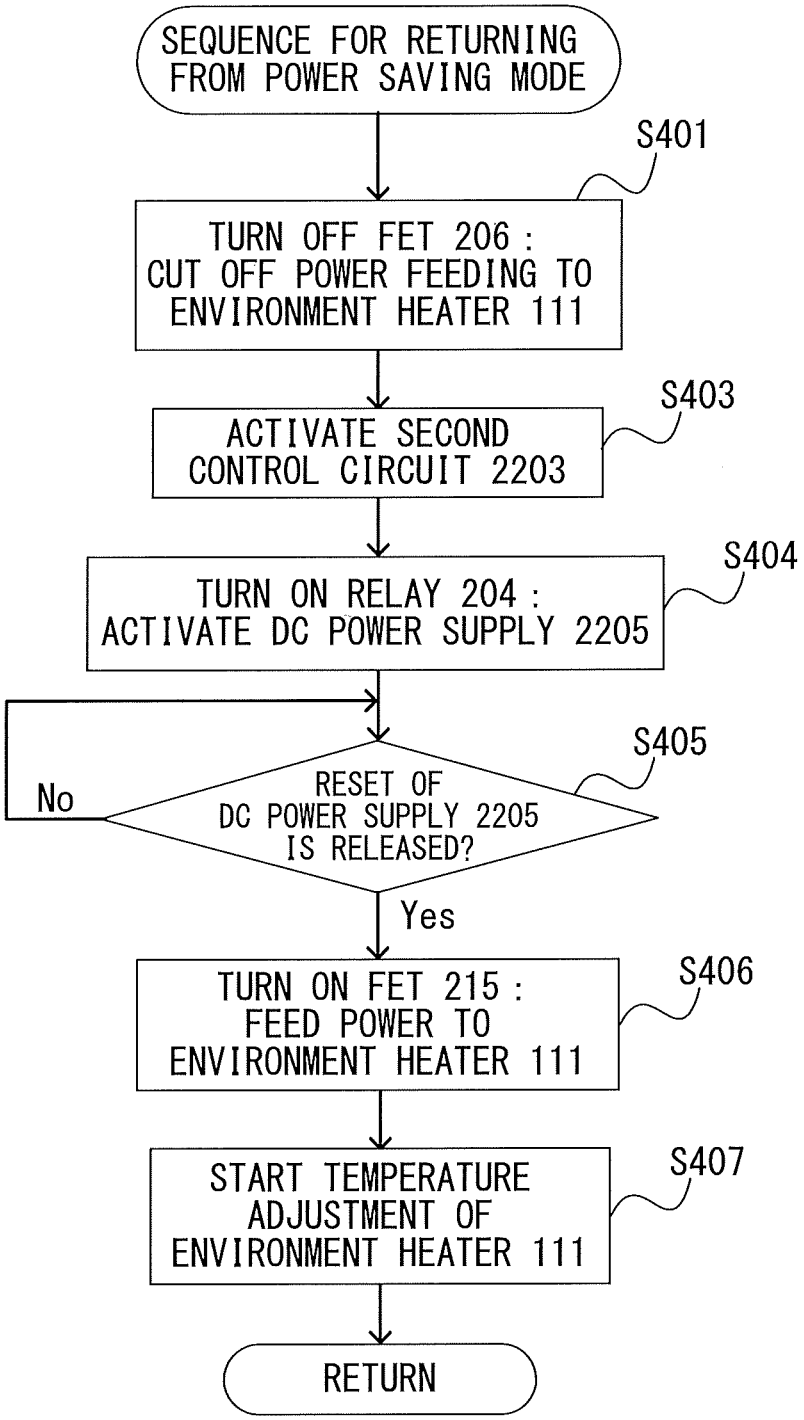
FIG. 17 is a flowchart for illustrating a return operation from the power saving mode.

Next, the sequence for returning from the power saving mode illustrated in Step S309 of FIG. 16, and operation of the first control circuit 2202 during that sequence, are described based on the control flowchart illustrated in FIG. 17.

After it is determined in Step S308 of FIG. 16 that a request to return from the power saving mode has been input (Step S308: Yes), the CPU 131 turns off the FET 206 to cut off power feeding from the DC power supply 2201 to the environment heater 111 (Step S401). The CPU 131 activates the second control circuit 2203 (Step S403), and turns on the relay 204 to activate the DC power supply 2205 (Step S404).

The CPU 131 determines whether or not release of a reset signal by the DC power supply 2205 has been detected (Step S405). When the reset signal is not released (Step S405: No), this means that the DC power supply 2205 is not activated, and hence the CPU 131 again executes Step S405. When it is determined that the reset signal has been released and the DC power supply 2205 is activated (Step S405: Yes), the CPU 131 turns on the FET 215 (Step S406) to start power feeding to the environment heater 111. Then, the CPU 131 performs, based on a detection result of the temperature sensor 210, temperature adjustment control so that a target temperature of the environment heater 111 is maintained (Step S407).

Figure 18:
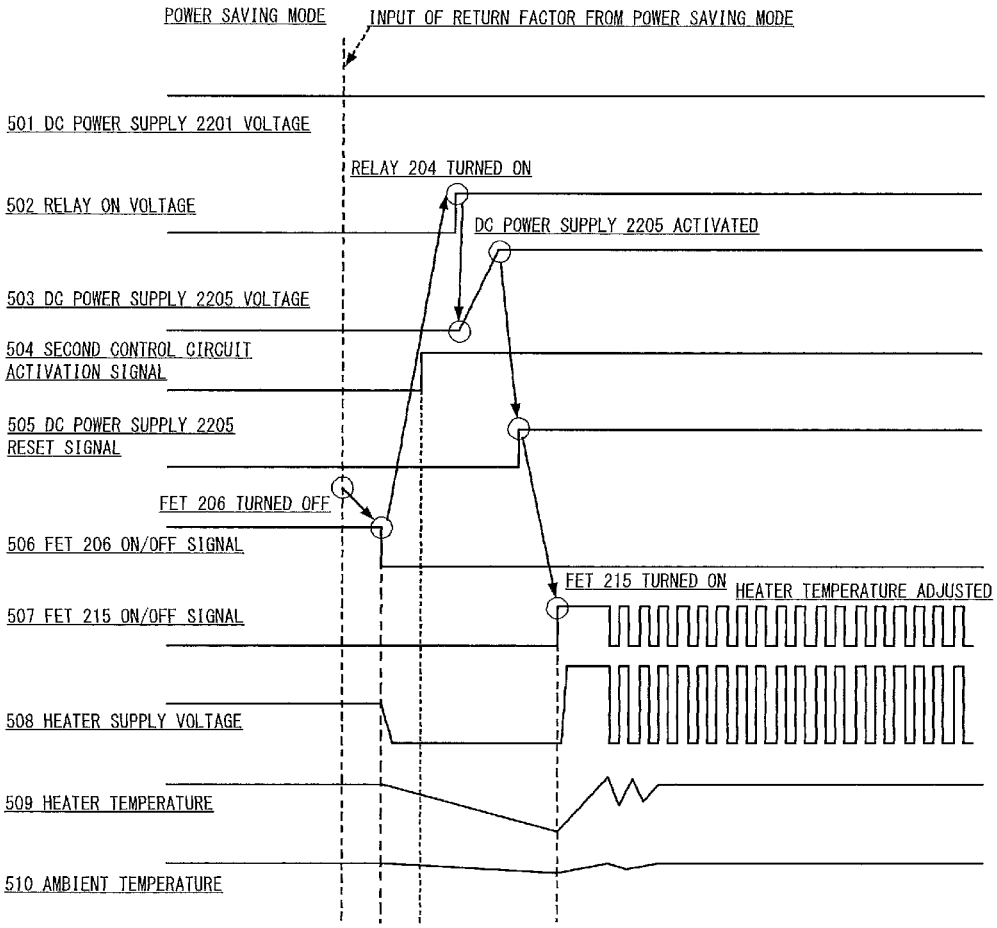
FIG. 18 is a flowchart for illustrating the return operation from the power saving mode.

Next, the operations performed in the image forming apparatus 2100 are described with reference to the timing chart of FIG. 18, which is for illustrating a return operation from the power saving mode. In FIG. 18, a DC power supply 2201 voltage 501, a relay ON voltage 502, a load drive DC power supply 2205 voltage 503, a second control circuit activation signal 504, a DC power supply 2205 reset signal 505, and a FET 206 ON/OFF signal 506 are illustrated. Further, a FET 215 ON/OFF signal 507, a heater supply voltage 508, a heater temperature 509, and an ambient temperature 510 are also illustrated in FIG. 18.

During the power saving mode, when a request to return from the power saving mode is input to the image forming apparatus 2100 (corresponding to Step S401 of FIG. 17), the value of the FET 206 ON/OFF signal 506 changes from high to low, and the FET 206 is turned off.

When the FET 206 is turned off, power feeding from the DC power supply 2201 to the environment heater 111 is cut off (corresponding to Step S401 of FIG. 17), and the value of the heater supply voltage 508 supplied to the environment heater 111 becomes zero. Together with this, the temperature of the environment heater 111 indicated by the heater temperature 509 also decreases.

The ambient temperature of the temperature control object of the environment heater 111 does not abruptly change in response to a temperature change of the environment heater 111. Therefore, the ambient temperature 510 gradually decreases as illustrated in FIG. 18. In other words, by the time that power is again supplied to the environment heater 111, the temperature does not decrease to a level that causes problems in the operation of the image forming apparatus 2100.

On the other hand, after the value of the FET 206 ON/OFF signal 506 changes to low, the value of the second control circuit activation signal 504 changes to high, and the second control circuit 2203 is activated (corresponding to Step S403 of FIG. 17). As a result, the relay ON voltage 502 changes to high, the relay 204 is turned on, and AC power is supplied to the DC power supply 2205. When the load drive DC power supply 2205 voltage 503 reaches a predetermined supply voltage, the DC power supply 2205 is activated (corresponding to Step S404 of FIG. 17).

When the value of the DC power supply 2205 reset signal 505 changes from low to high, the DC power supply 2205 reset signal 505 is released (corresponding to Step S405: Yes in FIG. 17), the value of the FET 215 ON/OFF signal 507 changes to high, and the FET 215 is turned on. As a result, power feeding to the environment heater 111 is started (corresponding to Step S406).

Then, based on the detection result of the temperature sensor 210, the FET 215 ON/OFF signal 507 is turned on/off at an appropriate timing so that the ambient temperature around the environment heater 111 is a desired temperature, and temperature adjustment control is executed (corresponding to Step S407). Thus, in the normal power mode, control for repeatedly turning on and off the FET 215 is performed. In that control, the power needed by the circuit to execute the control is more than in the control for simply switching elements, such as the FETs 206 and 208, from off to on and maintaining the on state.

The DC power supply 2205 supplied to the environment heater 111 is turned ON/OFF based on the turning ON/OFF of the FET 215, as indicated by the heater supply voltage 508. Together with that, the heater temperature 509 of the environment heater 111 also increases, and the temperature is stabilized by temperature adjustment control.

In this manner, the ambient temperature around the temperature control object of the environment heater 111 reaches the target temperature, and is maintained at the target temperature.

Next, the power of the environment heater 111 is described. A supply voltage from the DC power supply 2201 is represented by VA, a supply voltage from the DC power supply 2205 is represented by VB, and a resistance of the environment heater 111 is represented by Rh. When VA=5 V, VB=24 V, and Rh=5Ω, the power of the environment heater 111 is calculated as follows.

1) Power Wha of the environment heater 111 during power feeding from the DC power supply 2201

$$\begin{aligned} Wha &= (VA/Rh)\times VA \\ &= (5\ \text{V}/5\Omega)\times 5\ \text{V} \\ &= 5\ \text{W} \end{aligned}$$

2) Power Whb of the environment heater 111 during power feeding from the DC power supply 2205

$$\begin{aligned} Whb &= (VB/Rh)\times VB \\ &= (24\ \text{V}/5\Omega)\times 24\ \text{V} \\ &= 115.2\ \text{W} \end{aligned}$$

Therefore, when Step S407 of FIG. 17 is not executed, the power of the environment heater 111 becomes very large, and if left in that state, the environment heater 111 may cause a rapid temperature increase. This embodiment is effective in preventing such rapid increase. Further, in this embodiment, appropriate temperature control of the environment heater 111 may be performed even in modes other than the power saving mode.

Next, the operation illustrated in Step S306 of FIG. 16 of the image forming apparatus 2100 when shifting from the normal power mode to the power saving mode is described with reference to the control flowchart illustrated in FIG. 19.

After it is determined in Step S305 of FIG. 16 that there is a request to shift to the power saving mode (Step S305: Yes), the CPU 131 executes processing for shifting to the power saving mode by the first control circuit 2202 (Step S601). In the processing for shifting to the power saving mode, processing, e.g., backing up of the data necessary during operation, is performed. When the processing for shifting to the power saving mode ends, the CPU 131 turns off the FET 215 to stop power feeding from the DC power supply 2205 to the environment heater 111 (Step S603).

Next, the CPU 131 turns off the relay 204 to cut off the AC supply to the DC power supply 2205 (Step S604), and determines whether or not the DC power supply 2205 has been reset (Step S605). When the DC power supply 2205 has not been reset (Step S605: No), Step S605 is executed again. When the DC power supply 2205 has been reset (Step S605: Yes), the CPU 131 stops the second control circuit 2203 (Step S606). The CPU 131 turns on the FET 206 (Step S607) to enable the power feeding path from the DC power supply 2201 to the environment heater 111, and then completes the shift to the power saving mode (Step S608).

Figure 20:
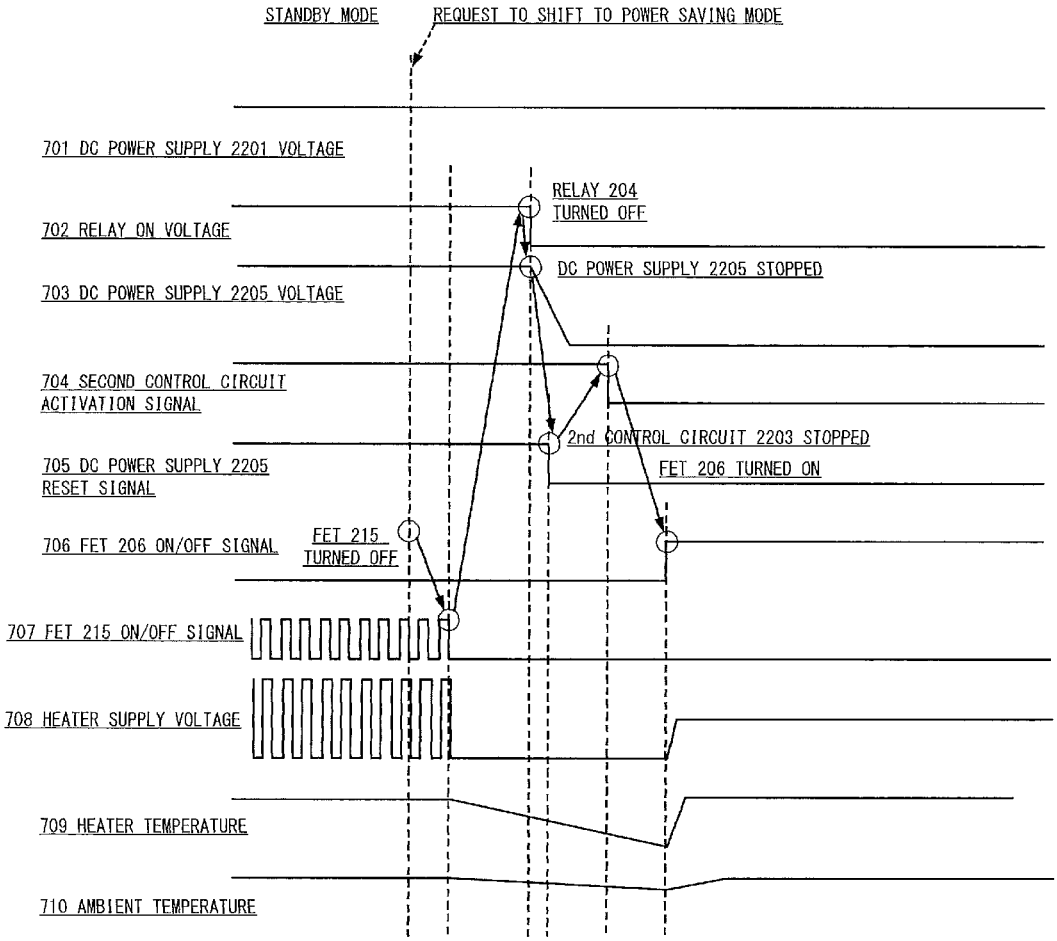
FIG. 20 is a timing chart for illustrating a shift operation to the power saving mode.

The processing executed by the image forming apparatus 2100 is now described with reference to the timing chart illustrated in FIG. 20. In FIG. 20, a DC power supply 2201 voltage 701, a relay ON voltage 702, a load drive DC power supply 2205 voltage 703, a second control circuit activation signal 704, a DC power supply 2205 reset signal 705, and a FET 206 ON/OFF signal 706 are illustrated. Further, a FET 215 ON/OFF signal 707, a heater supply voltage 708, a heater temperature 709, and an ambient temperature 710 are also illustrated in FIG. 20.

In FIG. 20, when a request to shift to the power saving mode is input to the system controller 2117 in a mode other than the power saving mode and executed (corresponding to Step S601 of FIG. 19), the FET 215 ON/OFF signal 707 is turned off. As a result, power feeding from the DC power supply 2205 to the environment heater 111 is stopped (corresponding to Step S603 of FIG. 19), and as indicated by the heater supply voltage 708, the supply voltage to the environment heater 111 becomes zero. The value of the FET 206 ON/OFF signal 706 changes from high to low, and the FET 206 is turned off.

When the FET 206 is turned off, power feeding from the DC power supply 2201 to the environment heater 111 is cut off (corresponding to Step S401 of FIG. 17), and the value of the heater supply voltage 708 supplied to the environment heater 111 becomes zero. Together with that, the temperature of the environment heater 111 indicated by the heater temperature 709 also decreases.

In this embodiment, the temperature control object of the environment heater 111 is inside a recording media storage unit or is the image forming unit. The ambient temperature of the temperature control object does not abruptly change in response to a temperature change of the environment heater 111. Therefore, the ambient temperature 710 gradually decreases as illustrated in FIG. 20. In other words, by the time that power is again supplied to the environment heater 111, the temperature does not decrease as far as a level that causes problems in operation of the image forming apparatus 2100.

Figure 19:
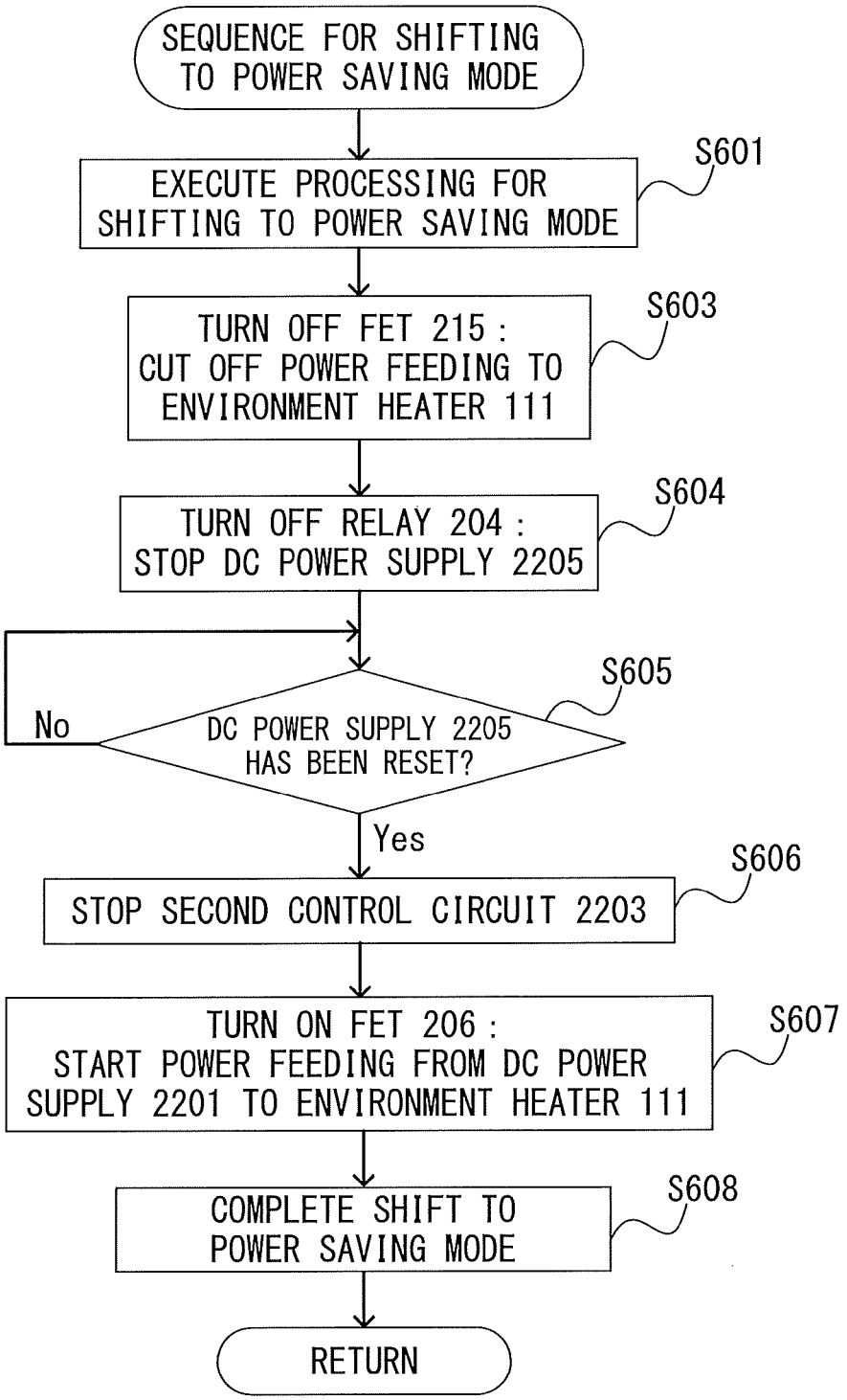
FIG. 19 is a flowchart for illustrating processing performed when shifting to the power saving mode.

After the value of the FET 215 ON/OFF signal 707 has changed to low, the value of the relay ON voltage 702 changes to low, the relay 204 is turned off, and the DC power supply 2205 is stopped (corresponding to Step S604 of FIG. 19). The CPU 131 confirms that the DC power supply 2205 has stopped based on the fact that the value of a reset signal by the DC power supply 2205 reset signal 705 has changed to low (corresponding to Step S605 of FIG. 19).

Then, the value of the second control circuit activation signal 704 changes from high to low, and the second control circuit 2203 is stopped (corresponding to Step S606 of FIG. 19). Next, the value of the FET 206 ON/OFF signal 706 changes from high to low, and the FET 206 is turned on. As a result, power feeding to the environment heater 111 is started (corresponding to Step S607 of FIG. 19), and the shift to the power saving mode is completed.

In the power saving mode, control is performed in this manner for maintaining the on state by switching the FET 206 from off to on. In that control, the power needed by the circuit executing the control is less than that in the control in which ON/OFF of elements such as the FETs 206 and 208 is repeated. It is preferred that the resistance value of the environment heater 111 be set to a value that enables control such as that described above to be performed in the power saving mode.

As described above, according to the second embodiment, the image forming apparatus 2100 has a power saving mode, and is configured to feed power to the environment heater 111 from the DC power supply 2201 during the power saving mode. When returning from the power saving mode, the power feeding path from the DC power supply 2201 is cut off. On the other hand, in the modes other than the power saving mode, power is fed to the environment heater 111 from the DC power supply 2205, which has a higher output than the DC power supply 2201. The voltage output from the DC power supply 2205 is higher than the voltage output from the DC power supply 2201. Through performing control in this manner, in the image forming apparatus 2100, sudden heating of the environment heater 111 during modes other than the power saving mode can be prevented and further consequences of such control can be suppressed.

Third Embodiment

Figure 21:
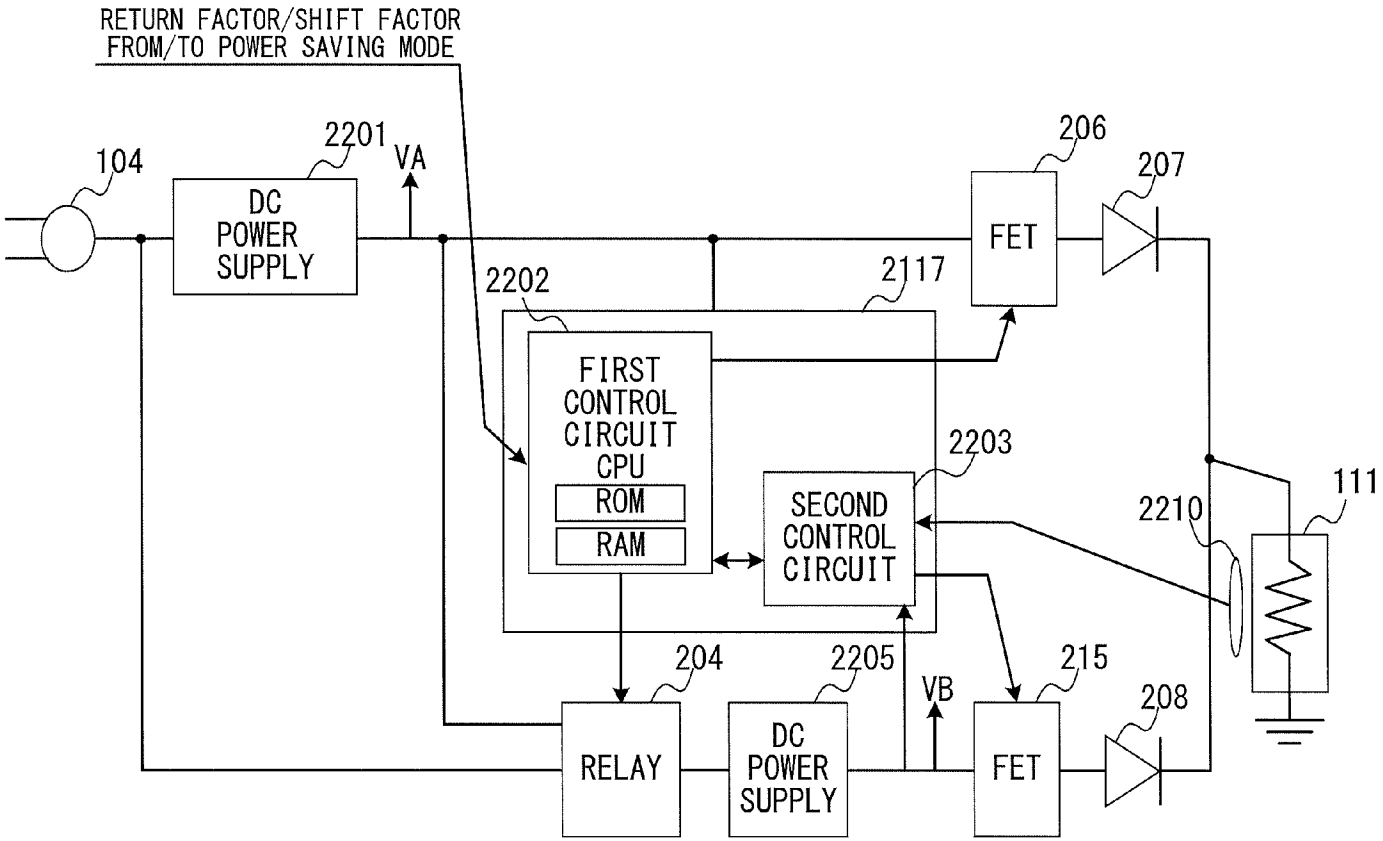
FIG. 21 is a function block diagram of an image forming apparatus according to a third embodiment of the present invention.

In a third embodiment of the present invention, power is supplied from the DC power supply 2205 to the second control circuit 2203 by using an image forming apparatus 2 in which the power efficiency during the power saving mode is further improved and the power supply capacity of the DC power supply 2201 is decreased. In FIG. 21, a function block diagram of the image forming apparatus 2 is illustrated.

As illustrated in FIG. 21, in the image forming apparatus 2, the second control circuit 2203 is configured to control the temperature of the environment heater 111 by referring to output from the temperature sensor 210 to control the FET 215. In the image forming apparatus 2100 described in the second embodiment, the first control circuit 2202 is configured to control the temperature of the environment heater 111 by referring to the temperature sensor 210 to control the FET 215. As illustrated in FIG. 21, the second control circuit 2203 is configured to receive the power feed from the DC power supply 2205. In the normal power mode, the DC power supply 2205 is driven, and in the modes other than the power saving mode, the second control circuit 2203 is driven by the DC power supply 2205. The third embodiment is different from the second embodiment in terms of that point.

In the power saving mode, similar to the second embodiment, the DC power supply 2205 is not driven, and hence the second control circuit 2203 does not receive the supply of power from the DC power supply 2205.

With such a configuration, in the normal power mode, the second control circuit 2203 is configured to adjust the temperature of the environment heater 111. Therefore, the first control circuit 2202 receiving the supply of power from the DC power supply 2201 is capable of suppressing power consumption without needing to adjust the temperature of the environment heater 111. In particular, this configuration is advantageous when control having a large power consumption is necessary, e.g., repeatedly turning ON/OFF the FET 215 in order to control the environment heater 111 in the normal power mode. The reason for this is that the output of the DC power supply 2201 can be suppressed to a low level due to the fact that it is not necessary for the DC power supply 2201 to perform control having a large power consumption.

In the power saving mode, similar to the second embodiment, the first control circuit 2202 is configured to adjust the temperature of the environment heater 111. Further, similar to the second embodiment, in the control of the environment heater 111 in the power saving mode, control is performed so that the power consumption is smaller than in the normal power mode. Such a configuration has an advantage in that output from the DC power supply 2201 can be suppressed to a level that is low enough to allow control having a low power consumption in the power saving mode to be performed. Other parts in the image forming apparatus 2 are similar to those of the image forming apparatus 2100. The image forming apparatus 2 is configured to execute the control flowchart illustrated in FIG. 16.

Figure 22:
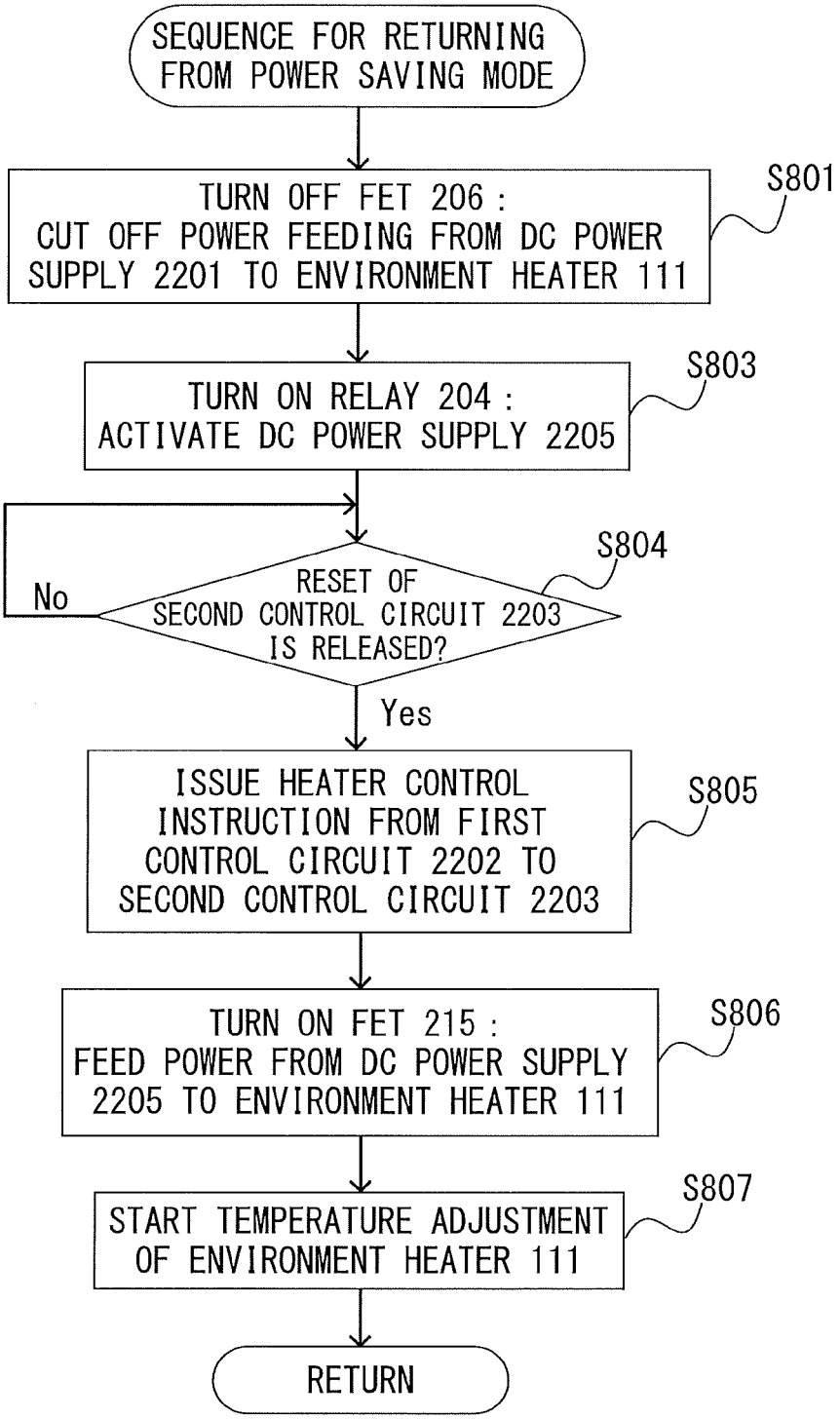
FIG. 22 is a flowchart for illustrating processing performed when shifting to the power saving mode in the third embodiment.

The processing executed in Step S309 of the control flowchart illustrated in FIG. 16 in the third embodiment is illustrated in the flowchart of FIG. 22.

After it is determined in Step S308 of FIG. 16 that a request to return from the power saving mode has been input (Step S308: Yes), the CPU 131 turns off the FET 206 to cut off power feeding from the DC power supply 2201 to the environment heater 111 (Step S801). The CPU 131 then turns on the relay 204 to activate the DC power supply 2205 (Step S803).

The CPU 131 determines whether or not the second control circuit 2203 has been activated by detecting that a reset signal (not shown) of the second control circuit 2203 has been released (Step S804). When the reset signal is not released (Step S804: No), this means that the second control circuit 2203 is not activated, and hence the CPU 131 again executes Step S804.

When it is determined that the second control circuit 2203 has been activated (Step S804: Yes), the first control circuit 2202 issues an instruction to the second control circuit 2203 to start temperature control of the environment heater 111 (Step S805). The second control circuit 2203 turns on the FET 215 (Step S806) to start power feeding to the environment heater 111, then refers to the temperature detected by the temperature sensor 210, and performs temperature adjustment control so that the target temperature is maintained (Step S807).

Thus, in the third embodiment, the temperature of the environment heater 111 is controlled in the power saving mode by the first control circuit 2202, and in the modes other than the power saving mode, such as the normal power mode, the temperature of the environment heater 111 is controlled by the second control circuit 2203.

Figure 23:
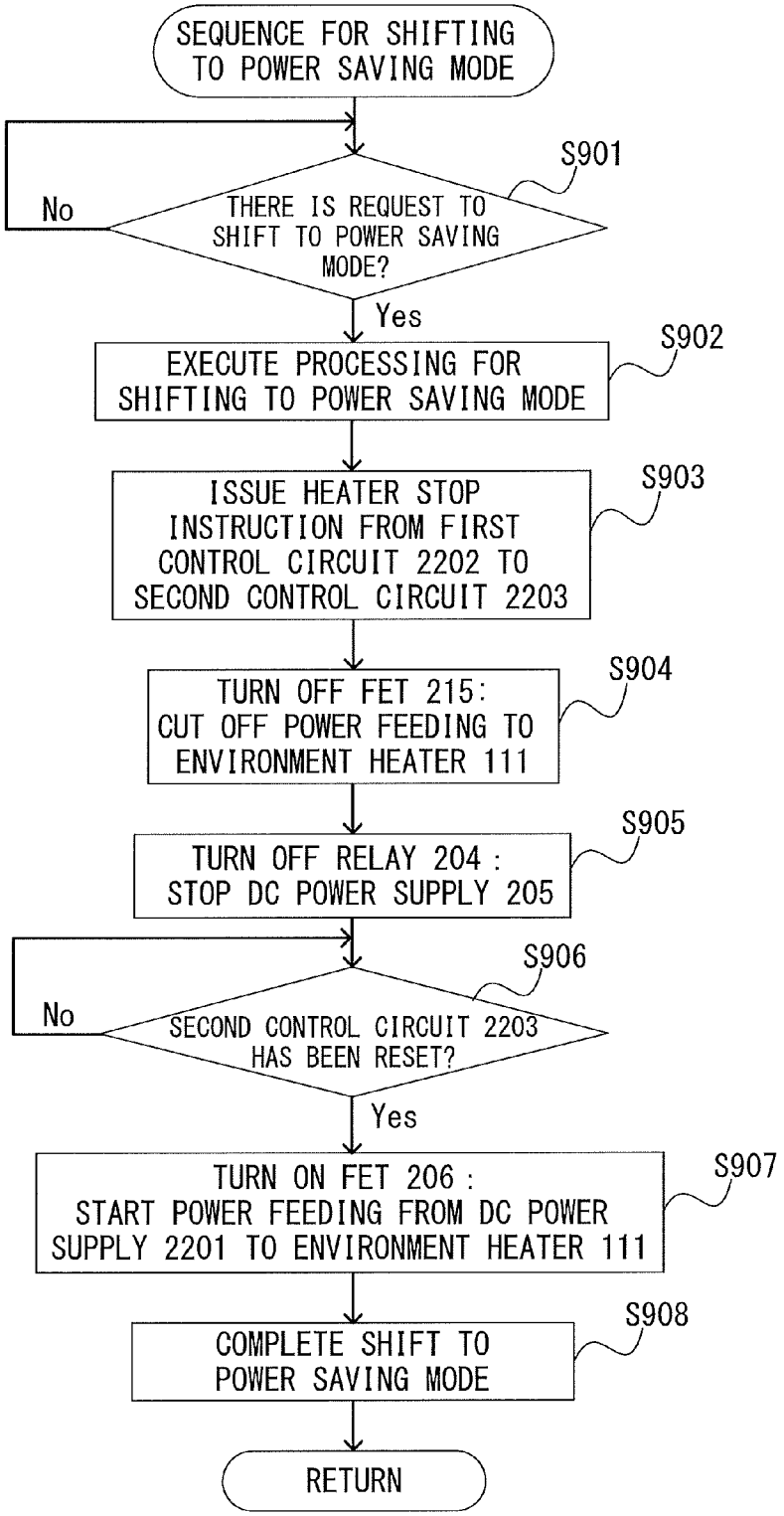
FIG. 23 is a flowchart for illustrating processing performed when shifting to the power saving mode in the third embodiment.

Next, the operation illustrated in Step S306 of FIG. 16 of the image forming apparatus 2 when shifting from the normal power mode to, for example, a power saving mode such as a sleep mode, is described with reference to the control flowchart illustrated FIG. 23.

After it is determined in Step S305 of FIG. 16 that there is a request to shift to the power saving mode (Step S305: Yes; S901: Yes), the CPU 131 of the first control circuit 2202 in the system controller 2117 executes processing for shifting to the power saving mode by the first control circuit 2202 (Step S902). In the processing for shifting to the power saving mode, processing, e.g., backing up of the data necessary during operation, is performed. When the processing for shifting to the power saving mode ends, the CPU 131 of the first control circuit 2202 issues an instruction to the second control circuit 2203 to stop temperature adjustment of the environment heater 111 (Step S903).

In response to the instruction, the second control circuit 2203 turns off the FET 215 to cut off power feeding from the DC power supply 2205 to the environment heater 111 (Step S904). Next, the CPU 131 turns off the relay 204 to stop the AC supply to the DC power supply 2205 (Step S905), and determines whether or not the second control circuit 2203 has been reset (Step S906). When the second control circuit 2203 has not been reset (Step S906: No), Step S906 is executed again. When the second control circuit 2203 has been reset (Step S906: Yes), the CPU 131 turns on the FET 206 (Step S907) to enable the path along which power is to be fed from the DC power supply 2201 to the environment heater 111, and then completes the shift to the power saving mode (Step S908).

As described above, according to the third embodiment, as in the second embodiment, sudden heating of the environment heater 111 during modes other than the power saving mode can be prevented and further consequences of such control can be suppressed.

In the above-mentioned embodiments, examples are described in which the environment heater 111 is arranged in the sheet feeding cassette 124. However, the environment heater 111 may be arranged in the image forming unit including a photosensitive drum to be used in image formation, or in the image reading unit 102.

The above-mentioned embodiments are given just for the purpose of describing the present invention more specifically, and the scope of the present invention is not limited by the embodiments.

According to the present invention, an increase in power during the power saving mode can be suppressed by switching the power feeding source of the heater based on the mode.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-176530, filed Sep. 8, 2015, No. 2015-176977, filed Sep. 8, 2015, and No. 2016-054256, filed Mar. 17, 2016 which are hereby incorporated by reference herein in their entirety.

What is claimed is:

1. An image forming apparatus having a first power mode and a second power mode in which power consumption is less than power consumption in the first power mode, the image forming apparatus comprising:

a first power supply unit configured to operate in the first power mode and the second power mode;

a second power supply unit configured to operate in the first power mode and not to operate in the second power mode;

an image forming unit configured to form an image;

a heater configured to heat the image forming unit;

a first switch for controlling a supply of power from the first power supply unit to the heater;

a second switch for controlling a supply of power from the second power supply unit to the heater; and a controller configured to (a), based on an instruction for shifting a power mode of the image forming apparatus from the first power mode to the second power mode, (i) turn off the second switch to stop supplying power from the second power supply unit to the heater, and (ii) turn on the first switch to start supplying power from the first power supply unit to the heater, and (b), based on an instruction for returning the power mode from the second power mode to the first power mode, (i) turn off the first switch to stop supplying power from the first power supply unit to the heater, and (ii) turn on the second switch to start supplying power from the second power supply unit to the heater.

2. An image forming apparatus according to claim 1, further comprising a detector configured to detect a current of the first power supply unit, wherein the controller is configured to control the first switch and the second switch based on a detection signal from the detector.

3. An image forming apparatus according to claim 1, further comprising a capacitive load connected in parallel to the heater, wherein the capacitive load is configured to supply power to the heater at a timing immediately after a switch between the first power supply unit and the second power supply unit to the heater.

4. An image forming apparatus according to claim 1, wherein the second power mode comprises a power saving mode, and wherein the first power mode comprises a standby mode for waiting for image formation to start.

5. An image forming apparatus according to claim 1, wherein the first power supply unit comprises a constant power supply unit, and wherein the second power supply unit comprises a non-constant power supply unit.

6. An image forming apparatus according to claim 1, wherein the first power supply unit and the second power supply unit each comprise a direct current power supply unit, and wherein the heater comprises a direct current heater.

7. An image forming apparatus according to claim 1, wherein the image forming apparatus is connectable to an external device via a network, and wherein the image forming apparatus is configured to shift from the second power mode to the first power mode when a network response request is received from the external device when the image forming apparatus is operating in the second power mode.

8. An image forming apparatus according to claim 1, wherein the image forming unit comprises a photosensitive member, and wherein the heater comprises a heater for heating the photosensitive member.

9. An image forming apparatus according to claim 1, wherein in the first power mode, power is supplied to the image forming unit from the second power supply unit, and wherein in the second power mode, power supply to the image forming unit is stopped.

10. An image forming apparatus according to claim 1, wherein the second power supply unit has a higher output than the first power supply unit.

11. An image forming apparatus according to claim 1, wherein the first power supply unit and the second power supply unit are configured to be fed with power from an alternating-current power supply and to output a direct current.

* * * * *